US010019950B2

(12) United States Patent
Tani et al.

(10) Patent No.: US 10,019,950 B2
(45) Date of Patent: Jul. 10, 2018

(54) PANEL DEFECT DETECTION METHOD AND ORGANIC LIGHT-EMITTING DISPLAY DEVICE USING THE SAME

(71) Applicant: LG DISPLAY CO., LTD., Seoul (KR)

(72) Inventors: Ryosuke Tani, Paju-si (KR); WooJin Nam, Goyang-si (KR); Shinji Takasugi, Paju-si (KR); KyungHyun Cho, Jeongeup-si (KR)

(73) Assignee: LG DISPLAY CO., LTD., Seoul (KR)

( * ) Notice: Subject to any disclaimer, the term of this patent is extended or adjusted under 35 U.S.C. 154(b) by 141 days.

(21) Appl. No.: 15/166,955

(22) Filed: May 27, 2016

(65) Prior Publication Data

US 2016/0351095 A1 Dec. 1, 2016

(30) Foreign Application Priority Data

May 29, 2015 (KR) ..... 10-2015-0076709

(51) Int. Cl.

*G09G 3/3266* (2016.01)
*G09G 3/3275* (2016.01)
*G09G 3/3233* (2016.01)
*G09G 3/3283* (2016.01)

(52) U.S. Cl.

CPC ..... *G09G 3/3275* (2013.01); *G09G 3/3233* (2013.01); *G09G 3/3283* (2013.01); *G09G 3/3266* (2013.01); *G09G 2320/0285* (2013.01); *G09G 2320/0295* (2013.01); *G09G 2320/046* (2013.01); *G09G 2330/021* (2013.01); *G09G 2330/08* (2013.01); *G09G 2330/12* (2013.01)

(58) Field of Classification Search

CPC ..... G09G 3/3266; G09G 3/3275; G09G 2330/021; G09G 2330/12; G09G 3/3233; G09G 3/3283; G09G 2320/0285; G09G 2320/0295; G09G 2320/046; G09G 2330/08

See application file for complete search history.

(56) References Cited

U.S. PATENT DOCUMENTS

| | | | | |
|---|---|---|---|---|
| 9,344,613 | B2 * | 5/2016 | Cote | H04N 5/2256 |
| 2009/0174628 | A1 * | 7/2009 | Wang | G09G 3/3225 345/76 |
| 2010/0053204 | A1 * | 3/2010 | Hwang | G09G 3/3648 345/618 |
| 2011/0084955 | A1 * | 4/2011 | Kim | G09G 3/3283 345/212 |
| 2014/0028649 | A1 * | 1/2014 | Kim | G09G 3/3233 345/212 |

* cited by examiner

*Primary Examiner* — Charles Hicks
(74) *Attorney, Agent, or Firm* — Dentons US LLP

(57) ABSTRACT

A panel defect detection method and an organic light emitting display device. A region having a high probability of a panel defect is intensively sensed through panel defect detection based on sensing results of characteristic values according to subpixels on sensing subpixel lines in an amount equal to the number of sensing subpixel lines preset in specific regions rather than all regions of a display panel. Rates and accuracy in detection of panel defects can be improved.

17 Claims, 23 Drawing Sheets

VTH SENSING

VSENSE WAVE

MOBILITY SENSING

VSENSE WAVE

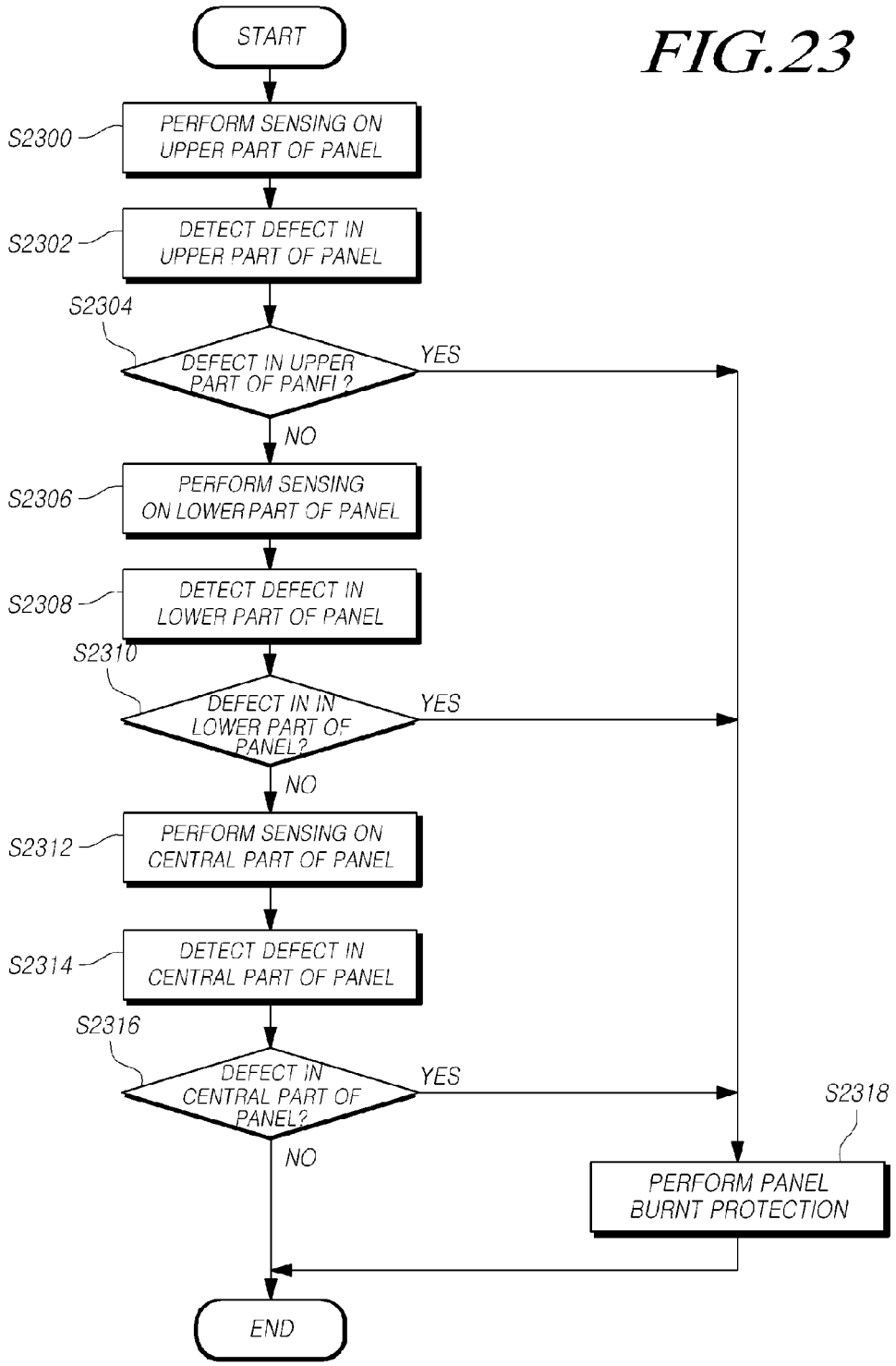
FIG.23
START
S2300
PERFORM SENSING ON UPPER PART OF PANEL
S2302
DETECT DEFECT IN UPPER PART OF PANEL
S2304
DEFECT IN UPPER PART OF PANEL?
YES
NO
S2306
PERFORM SENSING ON LOWER PART OF PANEL
S2308
DETECT DEFECT IN LOWER PART OF PANEL
S2310
DEFECT IN IN LOWER PART OF PANEL?
YES
NO
S2312
PERFORM SENSING ON CENTRAL PART OF PANEL
S2314
DETECT DEFECT IN CENTRAL PART OF PANEL
S2316
DEFECT IN CENTRAL PART OF PANEL?
YES
NO
S2318
PERFORM PANEL BURNT PROTECTION
END

PANEL DEFECT DETECTION METHOD AND ORGANIC LIGHT-EMITTING DISPLAY DEVICE USING THE SAME

CROSS REFERENCE TO RELATED APPLICATION

This application claims priority from Korean Patent Application No. 10-2015-0076709 filed on May 29, 2015, which is hereby incorporated by reference for all purposes as if fully set forth herein.

BACKGROUND

Field

The present disclosure relates to a panel defect detection method and an organic light-emitting display device using the same.

Description of Related Art

Organic light-emitting display devices, which have recently come to prominence as next generation display devices, have inherent advantages, such as relatively fast response speeds, high luminous efficiency, a high level of luminance, and wide viewing angles, since organic light-emitting diodes (OLEDs) used therein are able to emit light by themselves.

A variety of wiring and circuit elements are disposed on a display panel of such an organic light-emitting display device panel. The wiring and circuit elements may be electrically shorted or opened due to a variety of factors, such as impurity infiltration and external physical force.

When such a panel defect has occurred, the display panel may malfunction or the screen may have a problem. In a severe case, the display panel may be burnt and discarded. Thus, technologies capable of accurately and rapidly detecting a panel defect are in demand.

BRIEF SUMMARY

Accordingly, the present disclosure is directed to a panel defect detection method and an organic light-emitting display device using the same that substantially obviate one or more of the problems due to limitations and disadvantages of the related art.

Various aspects of the present disclosure provide an efficient display panel defect detection method and an efficient organic light-emitting display device.

Also provided are a method and an organic light-emitting display device able to detect a panel defect without a separate circuit and component for panel defect detection.

Also provided are a method and an organic light-emitting display device able to more accurately and more rapidly detect a panel defect without a separate circuit and component for panel defect detection.

Also provided are a method and an organic light-emitting display device able to detect a panel defect using a sensing value compensating for subpixel characteristic values.

Also provided are a method and an organic light-emitting display device able to rapidly detect a panel defect by primarily sensing a region having the high probability of the panel defect when a sensing operation for the panel defect detection is performed.

Also provided are a method and an organic light-emitting display device able to improve the detection accuracy of the panel defect by intensively sensing a region having the high probability of the panel defect when a sensing operation for the panel defect detection is performed.

According to an aspect of the present disclosure, an organic light-emitting display device may include: a display panel in which subpixels are disposed in a matrix, each subpixel including an organic light-emitting diode (OLED) and a driving transistor; a sensing unit sensing a voltage on a sensing line and outputting a sensing value, the sensing line being electrically connected to a first node of a driving transistor in each subpixel on sensing subpixel lines corresponding to subpixel lines among a plurality of subpixel lines; a memory storing sensing values according to the sensing subpixel lines in an amount equal to a predetermined number of sensing subpixel lines in at least one of predetermined regions in the display panel; and a detection unit detecting a panel defect based on the sensing values according to the sensing subpixel lines in an amount equal to a predetermined number of sensing subpixel lines in at least one of predetermined regions in the display panel.

According to another aspect of the present discloses, provided is a panel defect detection method of an organic light-emitting display device including a display panel in which subpixels are disposed in a matrix, each subpixel including an OLED and a driving transistor for driving the light-emitting diode, and a data driver connected to an upper portion or a lower portion of the display panel.

The panel defect detection method may include: performing sensing processing of sensing characteristic values of subpixels on sensing subpixel lines in an amount equal to a predetermined number of sensing subpixel lines in at least one of predetermined regions in the display panel, and outputting sensing values; and detecting a panel defect based on the sensing values according to the sensing subpixel lines in an amount equal to the number of the predetermined sensing subpixel lines.

The sensing subpixel lines in an amount equal to the number of the predetermined sensing subpixel lines may be subpixel lines in an upper panel region or a lower panel region.

According to the exemplary embodiments, it is possible to provide an efficient display panel defect detection method and an efficient organic light-emitting display device.

According to exemplary embodiments, it is possible to provide the method and the organic light-emitting display device able to detect a panel defect without a separate circuit and component for panel defect detection.

According to exemplary embodiments, it is possible to provide the method and the organic light-emitting display device able to more accurately and more rapidly detect a panel defect without a separate circuit and component for panel defect detection.

According to exemplary embodiments, it is possible to provide the method and the organic light-emitting display device able to detect a panel defect using a sensing value compensating for subpixel characteristic values.

According to exemplary embodiments, it is possible to provide the method and the organic light-emitting display device able to rapidly detect a panel defect by primarily sensing a region having the high probability of the panel defect when a sensing operation for the panel defect detection is performed.

According to exemplary embodiments, it is possible to provide the method and the organic light-emitting display device able to improve the detection accuracy of the panel defect by intensively sensing a region having the high probability of the panel defect when a sensing operation for the panel defect detection is performed.

It is to be understood that both the foregoing general description and the following detailed description are exemplary and explanatory and are intended to provide further explanation of the invention as claimed.

BRIEF DESCRIPTION OF THE DRAWINGS

The above and other objects, features and advantages of the present disclosure will be more clearly understood from the following detailed description when taken in conjunction with the accompanying drawings, in which:

FIG. 23 is a flowchart of a panel defect detection method according to exemplary embodiments.

DETAILED DESCRIPTION

Figure 1:
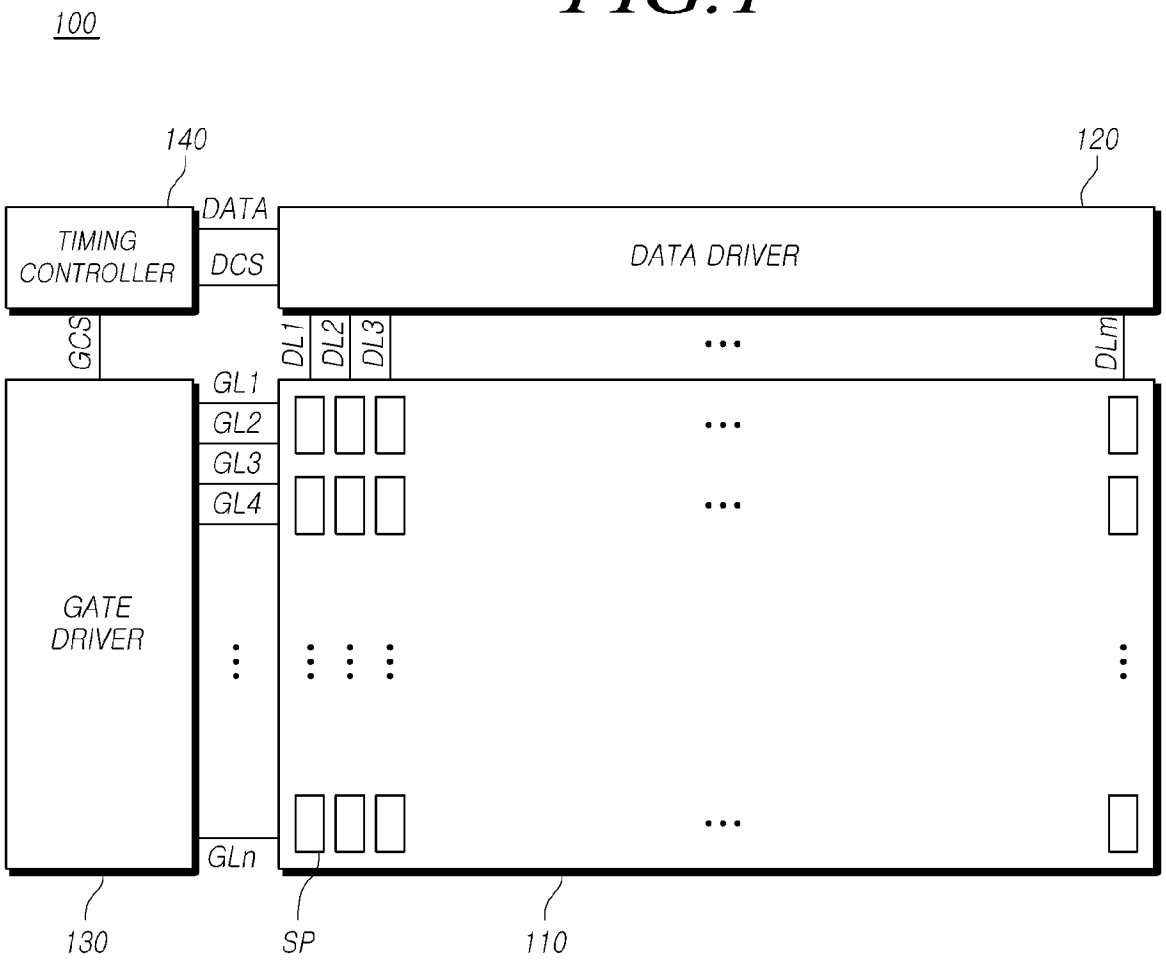
FIG. 1 is a configuration view illustrating an organic light-emitting display device according to exemplary embodiments.

Hereinafter, reference will be made to embodiments of the present disclosure in detail, examples of which are illustrated in the accompanying drawings. Throughout this document, reference should be made to the drawings, in which the same reference numerals and signs will be used to designate the same or like components. In the following description of the present disclosure, detailed descriptions of known functions and components incorporated herein will be omitted in the case that the subject matter of the present disclosure may be rendered unclear thereby.

It will also be understood that, while terms such as "first," "second," "A," "B," "(a)," and "(b)" may be used herein to describe various elements, such terms are only used to distinguish one element from another element. The substance, sequence, order or number of these elements is not limited by these terms. It will be understood that when an element is referred to as being "connected to" or "coupled to" another element, not only can it be "directly connected or coupled to" the other element, but it can also be "indirectly connected or coupled to" the other element via an "intervening" element. In the same context, it will be understood that when an element is referred to as being formed "on" or "under" another element, not only can it be directly formed on or under another element, but it can also be indirectly formed on or under another element via an intervening element.

FIG. 1 is a configuration view illustrating an organic light-emitting display device 100 according to exemplary embodiments.

Referring to FIG. 1, the organic light-emitting display device 100 according to exemplary embodiments includes a display panel 110, a data driver 120, a gate driver 130, a timing controller 140, and the like. The display panel 110 has a plurality of data lines DL1 to DLm, a plurality of gate lines GL1 to GLn, and a plurality of subpixels SP disposed thereon. The data driver 120 is connected to the upper part or the lower part of the display panel 110, and drives the plurality of data lines DL1 to DLm. The gate driver 130 drives the plurality of gate lines GL1 to GLn. The timing controller 140 controls the data driver 120 and the gate driver 130.

Referring to FIG. 1, a plurality of subpixels SP are arranged in the form of a matrix on the display panel 110.

Thus, a plurality of subpixel lines are present on the display panel 110. The plurality of subpixel lines may be subpixel rows or subpixel columns. Hereinafter, the subpixel lines will be described, by way of example, as the subpixel rows.

The data driver 120 drives the plurality of data lines DL1 to DLm by supplying data voltages to the plurality of data lines DL1 to DLm. Herein, the data driver 120 is also referred to as a source driver.

The gate driver 130 sequentially drives the plurality of gate lines GL1 to GLn by sequentially supplying scanning signals thereto. Herein, the gate driver 130 is also referred to as a scanning driver.

The timing controller 140 controls the data driver 120 and the gate driver 130 by supplying a variety of control signals thereto.

The timing controller 140 starts scanning based on timing realized by each frame, converts image data input from an external source into a data signal format readable by the data driver 120 and outputs the converted image data, and at a suitable point in time, regulates data processing in response to the scanning.

The gate driver 130 sequentially drives the plurality of gate lines GL1 to GLn by sequentially supplying scanning signals respectively having an on or off voltage thereto under the control of the timing controller 140.

The gate driver 130 is positioned on one side of the display panel 110, as illustrated in FIG. 1. Alternatively, the gate driver 130 may be positioned on both sides of the display panel 110 depending on the driving system, the design of the panel, or the like.

In addition, the gate driver 130 may include one or more gate driver integrated circuits (GDICs).

Each of the GDICs may be connected to the bonding pads of the display panel 110 by tape-automated bonding (TAB) or chip-on-glass (COG) bonding, may be implemented as a gate-in-panel (GIP)-type IC directly disposed on the display panel 110, or in some cases, may be integrated on the display panel 110.

Each of the GDICs may include a shift register, a level shifter, and the like.

When a specific gate line is opened, the data driver 120 converts image data received from the controller into analog data voltages Vdata and supplies the analog data voltages Vdata to the plurality of data lines DL1 to DLm, thereby driving the plurality of data lines DL1 to DLm.

The data driver 120 may include one or more source driver ICs (SDICs) to drive the plurality of data lines.

Each of the SDICs may be connected to the bonding pads of the display panel 110 by tape-automated bonding (TAB) or chip-on-glass (COG) bonding, may be directly disposed on the display panel 110, or in some cases, may be integrated on the display panel 110.

Each of the SDICs may include a logic unit including a shift register and a latch circuit, a digital-to-analog converter (DAC), an output buffer, and the like. In some cases, each of the SDICs may further include a sensing unit (310, FIG. 3) sensing characteristic values of the corresponding subpixel (e.g. a threshold voltage and mobility of a driving transistor, the threshold voltage of an organic light-emitting diode (OLED), the luminance of the corresponding subpixel, and the like) in order to compensate for the characteristic values of the corresponding subpixel.

In addition, each of the SDICs may be mounted on a film connected to the OLED display panel 100 by a chip-on-film (COF) method. In this case, one end of each of the SDICs is bonded to at least one source printed circuit board (S-PCB, 800, FIG. 8) and the other end of each of the SDICs is bonded to the display panel 110.

The timing controller 140 receives a variety of timing signals including a vertical synchronization signal Vsync, a horizontal synchronization signal Hsync, an input data enable (DE) signal, and a clock signal, as well as input image data, from an external source (e.g. an external host system).

The timing controller 140 not only converts image data input from an external source into a data signal format readable by the data driver 120 and outputs the converted image data, but also generates a variety of control signals by receiving a variety of received timing signals, including a vertical synchronization signal Vsync, a horizontal synchronization signal Hsync, an input DE signal, and a clock signal, and outputs the variety of control signals to the data driver 120 and the gate driver 130 in order to control the data driver 120 and the gate driver 130.

For example, the timing controller 140 outputs a variety of gate control signals (GCSs) including a gate start pulse (GSP), a gate shift clock (GSC) signal, and a gate output enable (GOE) signal in order to control the gate driver 130.

Here, the GSP controls the operation start timing of one or more gate driver ICs (GDICs) of the gate driver 130. The GSC signal is a clock signal commonly input to the GDICs to control the shift timing of scanning signals (gate pulses). The GOE signal designates the timing information of one or more GDICs.

In addition, the timing controller 140 outputs a variety of data control signals (DCSs) including a source start pulse (SSP), a source sampling clock (SSC) signal, and a source output enable (SOE) signal in order to control the data driver 120.

Here, the SSP controls the data sampling start timing of one or more SDICs of the data driver 120. The SSC signal is a clock signal controlling the data sampling timing of each of the SDICs. The SOE signal controls the output timing of the data driver 120.

Referring to FIG. 1, the timing controller 140 may be disposed on a control printed circuit board (C-PCB) to which the S-PCB (800, FIG. 8) having one or more SDICs bonded thereto is connected via a connector, such as a flexible flat cable (FFC) or a flexible printed circuit (FPC).

The C-PCB may have a power controller (not shown) disposed thereon. The power controller (not shown) supplies a variety of voltages or currents to the display panel 110, the data driver 120, the gate driver 130, and the like or controls the supply of the variety of voltages or currents to the same. The power controller (not shown) is also referred to as a power management IC (PMIC).

The S-PCB and the C-PCB may be integrated as a single PCB.

In the organic light-emitting display device 100 according to exemplary embodiments, each of the subpixels SP includes circuit elements, such as an OLED and a driving transistor DRT for driving the OLED.

The types and number of the circuit elements of each of the subpixels SP may be determined variously depending on functions provided thereby, the design thereof, and the like.

In the organic light-emitting display device 100, circuit elements, such as OLEDs and driving transistors DRT, may undergo degradations in quality along with the lapse of the driving times of the subpixels SP. This may consequently change unique characteristic values (e.g. threshold voltages and mobility) of circuit elements, such as OLEDs and driving transistors DRT.

The degrees of changes in characteristic values among circuit elements may differ depending on the degrees of degradations thereof.

Such deviations in characteristic values among circuit elements may cause deviations in luminance among subpixels. This may consequently degrade the luminance uniformity of the display panel 110, thereby lowering image quality.

In this regard, the organic light-emitting display device 100 according to exemplary embodiments provides a "subpixel compensation function" to compensate for deviations in characteristic values among circuit elements of the subpixels SP.

In the organic light-emitting display device 100 according to exemplary embodiments, each of the subpixels SP has a structure enabling subpixel characteristic values to be sensed and deviations in subpixel characteristic values to be compensated for.

In addition, the organic light-emitting display device 100 according to exemplary embodiments may include a sensing configuration for sensing subpixel characteristic values and a compensation configuration for compensating for deviations in subpixel characteristic values among subpixels in order to provide the subpixel compensation function.

Here, subpixel characteristic values may include, for example, characteristic values of OLEDs, such as threshold voltages, and characteristic values of driving transistors DRT, such as threshold voltages and mobility. Hereinafter, the subpixel characteristic values will be described, by way of example, as threshold voltages and mobility of driving transistors DRT.

Figure 2:
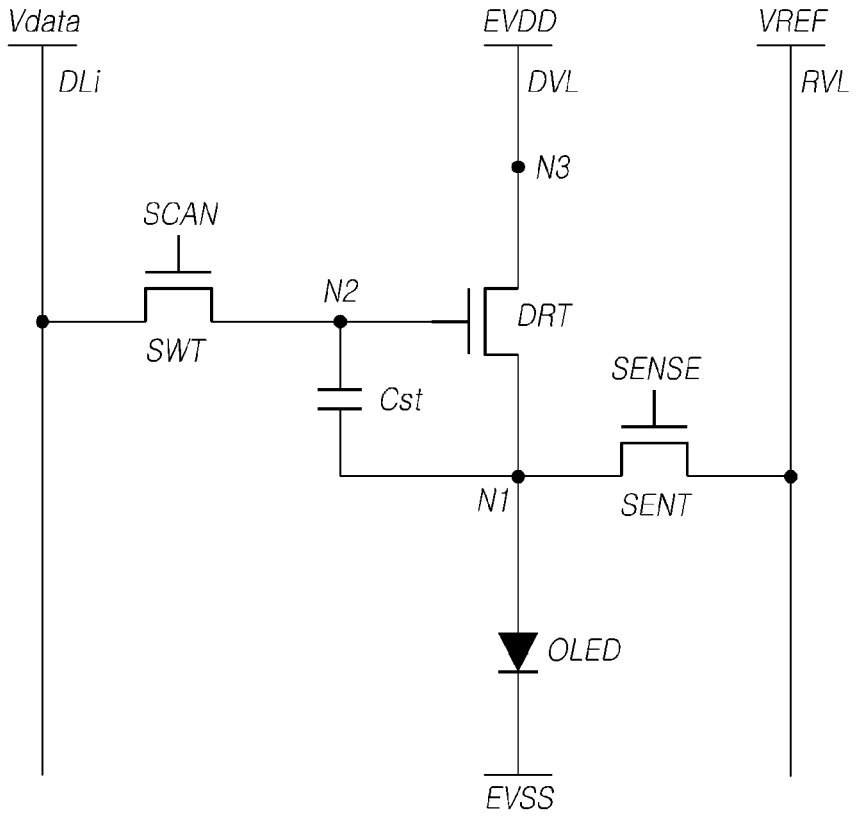
FIG. 2 is a diagram illustrating a subpixel circuit of the organic light-emitting display device according to exemplary embodiments.

FIG. 2 is a diagram illustrating a subpixel circuit of the organic light-emitting display device 100 according to exemplary embodiments.

The subpixel illustrated in FIG. 2 is a subpixel that has a data voltage Vdata supplied thereto from an ith data line DLi, where $1 \leq i \leq m$, and has a structure enabling subpixel characteristic values to be sensed and deviations in subpixel characteristic values to be compensated for.

Referring to FIG. 2, each of the subpixels of the organic light-emitting display device 100 according to exemplary embodiments includes an OLED and a driving circuit for driving the OLED.

The driving circuit includes a driving transistor DRT, a switching transistor SWT, a sensing transistor SENT, and a storage capacitor Cst.

The driving transistor DRT drives the OLED by supplying a driving current to the OLED.

The driving transistor DRT is connected between the OLED and a driving voltage line DVL through which a driving voltage EVDD is supplied.

The driving transistor DRT includes a first node N1 corresponding to a source node or a drain node, a second node N2 corresponding to a gate node, and a third node corresponding to the drain node or the source node.

The switching transistor SWT is connected between the data line DLi and the second node N2 of the driving transistor DRT, and is turned on in response to a scanning signal SCAN applied to a gate node.

The switching transistor SWT is turned on by the scanning signal SCAN to transfer a data voltage Vdata, supplied from the data line DLi, to the second node N2 of the driving transistor DRT.

The sensing transistor SENT is connected between the first node N1 of the driving transistor DRT and a reference voltage line RVL, through which a reference voltage VREF is supplied, and is turned on in response to a sensing signal SENSE, i.e. a type of scanning signal, applied to a gate node.

The sensing transistor SENT is turned on by the sensing signal SENSE to apply the reference voltage VREF, supplied through the reference voltage line RVL, to the first node N1 of the driving transistor DRT.

The sensing transistor SENT may also act as a sensing passage through which the sensing configuration can sense a voltage at the first node N1 of the driving transistor DRT.

Alternatively, the scanning signal SCAN and the sensing signal SENSE may be applied to the gate node of the switching transistor SWT and the gate node of the sensing transistor SENT through different gate lines.

In some cases, the scanning signal SCAN and the sensing signal SENSE may the same signal applied to the gate node of the switching transistor SWT and the gate node of the sensing transistor SENT through the same gate line.

Figure 3:
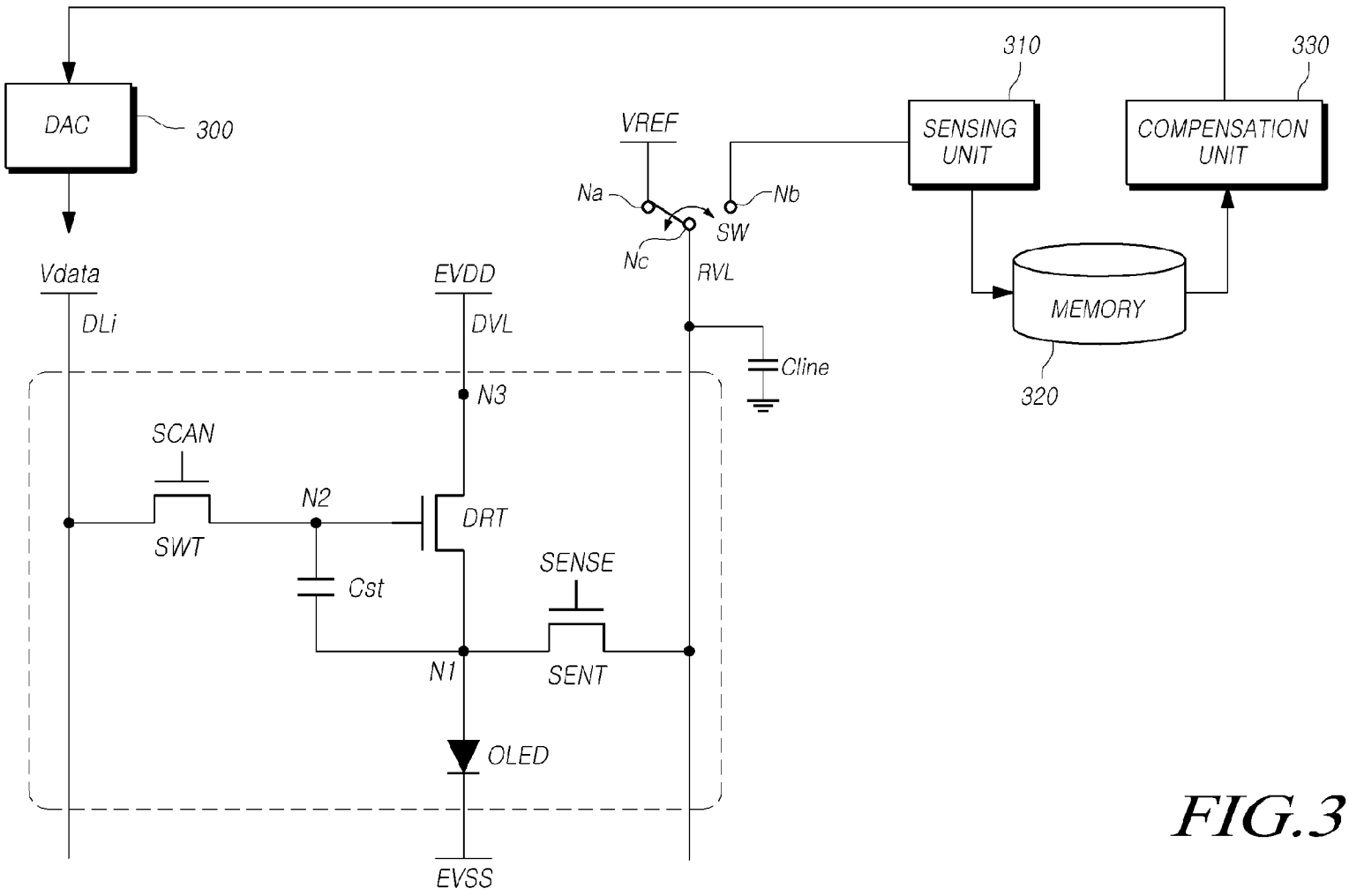
FIG. 3 is a diagram illustrating a subpixel compensation circuit of the organic light-emitting display device according to exemplary embodiments.

FIG. 3 is a diagram illustrating a subpixel compensation circuit of the organic light-emitting display device 100 according to exemplary embodiments.

Referring to FIG. 3, the organic light-emitting display device 100 according to exemplary embodiments includes a sensing unit 310 sensing subpixel characteristic values, a memory 320 storing data sensed by the sensing unit 310, and a compensation unit 330 compensating for a deviation in subpixel characteristic values.

Here, for example, the sensing unit 310 may be included in the SDICs, and the compensation unit 330 may be included in the timing controller 140.

The organic light-emitting display device 100 according to exemplary embodiments may further include a switch SW to control sensing driving, i.e. to control a voltage application state of the first node N1 of the driving transistor DRT in each of the subpixels SP to be a state for sensing subpixel characteristic values.

The switch SW allows one end Nc of the reference voltage line RVL to be connected to a reference voltage supply node Na or a node Nb of the sensing unit 310.

Referring to FIG. 3, the reference voltage line RVL is basically a line through which a reference voltage VREF is supplied to the first node N1 of the driving transistor DRT through the sensing transistor SENT.

In addition, a line capacitor Cline is formed on the reference voltage line RVL, and at a predetermined point in time, the sensing unit 310 senses a voltage charged in the line capacitor Cline on the reference voltage line RVL. Thus, herein, the reference voltage line RVL is also described as a sensing line.

A single reference voltage line RVL as described above may be disposed in every subpixel row or may be disposed in at least every second subpixel row.

For example, when a pixel is composed of four subpixels (red, white, green, and blue subpixels), a single reference voltage line may be present in every pixel row.

The sensing unit 310 may perform sensing processing by sensing a voltage on the sensing line RVL electrically connected to the first node N1 of the driving transistor DRT in each subpixel in at lease one more sensing subpixel line (SSPL), on which sensing driving is performed, from among the plurality of subpixel lines, and outputting the sensed voltage.

The sensing unit 310 can sense a voltage charged in the capacitor Cline on the sensing line by current flowing through the sensing line RVL.

Here, the voltage charged in the line capacitor Cline is a voltage on the sensing line RVL, and indicates a voltage at the first node N1 of the driving transistor DRT reflecting characteristic components (e.g. a threshold voltage and mobility) of the driving transistor DRT.

In the case of sensing driving, the voltage at the first node N1 of the driving transistor DRT is stored in the line capacitor Cline, and the sensing unit 310 senses the voltage charged in the line capacitor Cline storing the voltage of the first node N1 of the driving transistor DRT without directly sensing the voltage at the first node N1 of the driving transistor DRT. Thus, when the sensing transistor SENT is turned off, the voltage at the first node N1 of the driving transistor DRT can be sensed.

Each of the subpixels may be driven to sense the threshold voltage of the driving transistor DRT or may be driven to sense the mobility of the driving transistor DRT.

Thus, a sensing value sensed by the sensing unit 310 may be a sensing value for sensing the threshold voltage Vth of the driving transistor DRT or may be a sensing value for sensing the mobility of the driving transistor DRT.

When the subpixel is driven to sense the threshold voltage of the driving transistor DRT (threshold voltage sensing driving), the first node N1 and the second node N2 of the driving transistor DRT are initialized to a data voltage Vdata for threshold voltage sensing driving (or a threshold voltage sensing driving data voltage Vdata) and a reference voltage VREF. Afterwards, the first node N1 of the driving transistor DRT is floated, and the voltage of the first node N1 of the driving transistor DRT rises. After a predetermined period of time, the voltage at the first node N1 of the driving transistor DRT is saturated.

The saturated voltage Vdata-Vth on the first node N1 of the driving transistor DRT is charged in the line capacitor Cline on the sensing line RVL.

The sensing unit 310 senses the voltage charged in the line capacitor Cline at sensing timing (sampling timing). The sensed voltage Vsense corresponds to a voltage obtained by subtracting the threshold voltage Vth of the driving transistor DRT from the data voltage Vdata.

When the subpixel is driven to sense the mobility of the driving transistor DRT (mobility sensing driving), the first node N1 and the second node N2 of the driving transistor DRT are initialized to a mobility sensing driving data voltage Vdata and a reference voltage VREF. Afterwards, both the first node N1 and the second node N2 of the driving transistor DRT are floated, causing a voltage rise.

Here, the voltage rise rate (an amount of change in voltage rise per time) indicates the current capability, i.e. the mobility, of the driving transistor DRT. The greater the current capability (mobility) of the driving transistor DRT is, the more sharply the voltage at the first node N1 of the driving transistor DRT rises.

In response to the voltage rise, the line capacitor Cline on the sensing line RVL is charged with current flowing to the sensing line RVL through the driving transistor DRT.

The sensing unit 310 senses the voltage Vsense charged in the line capacitor Cline on the sensing line RVL.

The memory 320 can store SSPL-specific sensing values, i.e. sensing values according to the sensing subpixel lines (SSPL), in an amount equal to a predetermined number (N) of sensing subpixel lines (SSPL).

The predetermined number (N) of sensing subpixel lines may be equal to or less than the number of all subpixel lines present in the display panel 110 depending on the available capacity of the memory 320 or the like.

In the following description, the predetermined number (N) of sensing subpixel lines will be assumed to be less than the number of all subpixel lines. The number (N) of sensing subpixel lines will be described, by way of example, as 35.

For example, when the organic light-emitting display device 100 has an RWGB pixel structure with 1920×1080 resolution (i.e. m=4×1920 and n=1080), 35 subpixel lines from among 1080 subpixel lines are sensed as sensing subpixel lines (SSPL).

The compensation unit 330 can perform characteristics compensation processing by determining characteristic values (e.g. a threshold voltage and mobility) of the driving transistor DRT in the corresponding subpixel.

Here, the characteristics compensation processing may include threshold voltage compensation processing of compensating for the threshold voltage of the driving transistor DRT and mobility compensation processing of compensating for the mobility of the driving transistor DRT.

The threshold voltage compensation processing may include operations intended to compensate for the threshold voltage, i.e. calculating a compensation value, storing the calculated compensation value in the memory 320, and changing corresponding image data using the calculated compensation value.

The mobility compensation processing may include operations intended to compensate for the mobility, i.e. calculating a compensation value, storing the calculated compensation value in the memory 320, and changing corresponding image data using the calculated compensation value.

The compensation unit 330 may change the image data through the threshold voltage compensation processing or the mobility compensation processing and supply the changed image data to the corresponding SDIC.

Here, a digital-to-analog converter (DAC) 300 in the SDIC converts the image data to data voltages Vdata corresponding to analog voltages and supplies the converted data voltages Vdata to the corresponding subpixel, whereby characteristics compensation (threshold voltage compensation and mobility compensation) is actually applied.

It is possible to reduce or prevent deviations in luminance among subpixels by compensating for the characteristic values of the driving transistor using the compensation unit 330.

Hereinafter, a principle of threshold voltage (Vth) sensing on a driving transistor DRT so as to compensate for a threshold voltage deviation in the driving transistor DRT will be described with reference to FIG. 4. Next, a principle of mobility sensing on the driving transistor DRT so as to compensate for a mobility deviation in the driving transistor DRT will be described with reference to FIG. 5.

The above-described sensing unit 310 may be implemented with an analog-to-digital converter (ADC) converting an analog voltage value into a digital value.

The sensing unit 310 may be included inside of the data driver 120. In some cases, the sensing unit 310 may be included outside of the data driver 120, or may be included in the timing controller 140.

Figure 4:
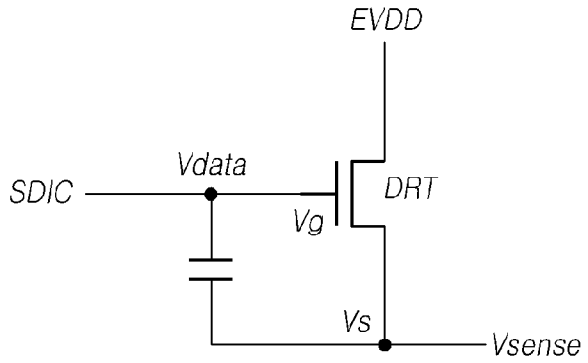
FIG. 4 is a diagram illustrating a principle of threshold voltage sensing on a driving transistor of the organic light-emitting display device according to exemplary embodiments.
Figure 4:
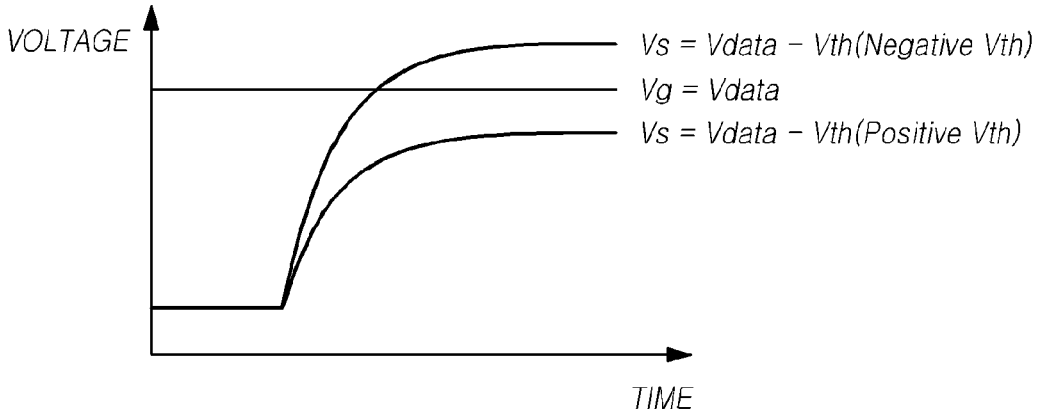

FIG. 4 is a diagram illustrating a principle of threshold voltage sensing on a driving transistor DRT of an organic light-emitting display 100. Here, a first node N1 of the driving transistor DRT is depicted as a source node, but the present discloses are not limited thereto.

A principle of the threshold voltage sensing will be briefly described with reference to FIG. 4. A source following operation is performed so that a voltage Vs of the source node N1 of the driving transistor DRT follows a voltage Vg of a gate node N2, and after the voltage Vs of the source node N1 of the driving transistor DRT is saturated, the voltage Vs of the source node N1 of the driving transistor DRT is sensed as a sensing voltage Vsense. At this time, a change in the threshold voltage of the driving transistor DRT may be detected based on the sensed sensing voltage Vsense.

Since the threshold voltage sensing of the driving transistor DRT is performed after the driving transistor DRT is turned off, the threshold voltage sensing of the driving transistor DRT is characterized by a sensing speed being slow. Therefore, a threshold voltage sensing mode is also referred to as a slow mode (S-Mode).

A voltage Vg applied to the gate node N2 of the driving transistor DRT is a data voltage Vdata supplied by a corresponding source driver integrated circuit SDIC.

Figure 5:
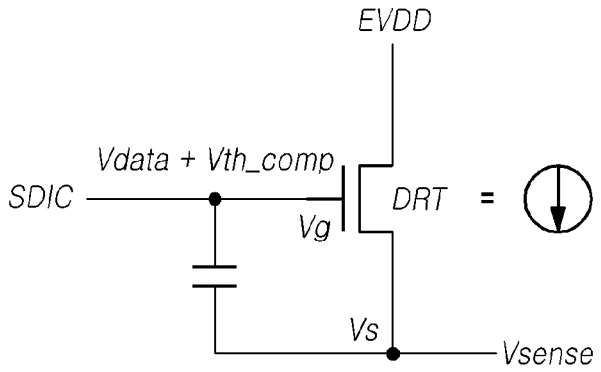
FIGS. 5 and 6 are diagrams illustrating a principle of mobility sensing on a driving transistor of the organic light-emitting display device according to exemplary embodiments.
Figure 5:
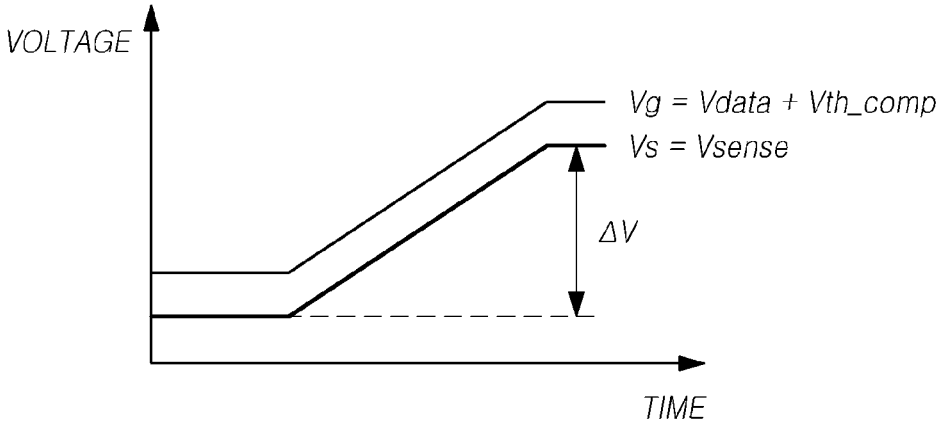
Figure 6:
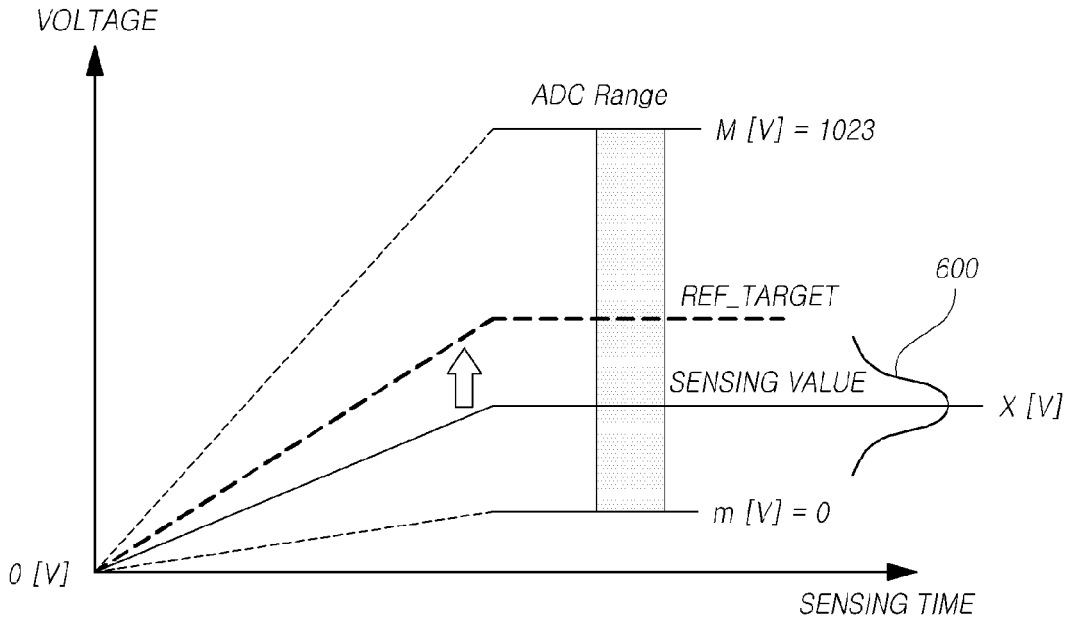

FIGS. 5 and 6 are diagrams illustrating a principle of mobility sensing on the driving transistor DRT of the organic light-emitting display device 100 according to exemplary embodiments.

A principle of the mobility sensing on the driving transistor DRT will be briefly described with reference to FIG. 5. A voltage corresponding to the sum of the data voltage Vdata and a constant voltage Vth_comp is applied to the gate node N2 of the driving transistor DRT. Here, the constant voltage Vth_comp is a voltage corresponding to a threshold voltage compensation value.

Therefore, it is possible to relatively detect a current capability (i.e., mobility) of the driving transistor DRT through a voltage amount ΔV charged in a line capacitor Cline for a certain period of time, and it is possible to calculate a compensation gain for compensating through the current capability.

Since the driving transistor DRT is fundamentally turned on, the mobility sensing is characterized in that a sensing speed is fast. Therefore, a mobility sensing mode is also referred to as a fast mode (F-Mode).

A mobility compensation operation through the above-described mobility sensing may be performed during a certain period of time when a screen is driven. In this manner, it is possible to sense and compensate for parameters of the driving transistor DRT which change in real time.

FIG. 6 is a graph showing a change in the voltage at the first node N1 of the driving transistor DRT according to a sensing time in mobility sensing driving.

Referring to FIG. 6, in order for the mobility sensing to be undertaken, a sensing value sensed by the sensing unit 310 is converted into a digital value.

The sensing unit 310 has an ADC range from a digital value of 0 corresponding to m [V] to a digital value of 1023 corresponding to M [V].

Sensing values according to all subpixels in the display panel 110 have a certain distribution 600. The certain distribution 600 corresponds to a distribution of the mobility of the driving transistor DRT in all subpixels of the display panel 110.

When a sensing value X [V] sensed in any subpixel is different from a reference value REF_TARGET, the compensation unit 330 may perform mobility compensation by changing original data into a compensation value corresponding to the difference between the sensing value X [V] and the reference value REF-TARGET.

Figure 7:
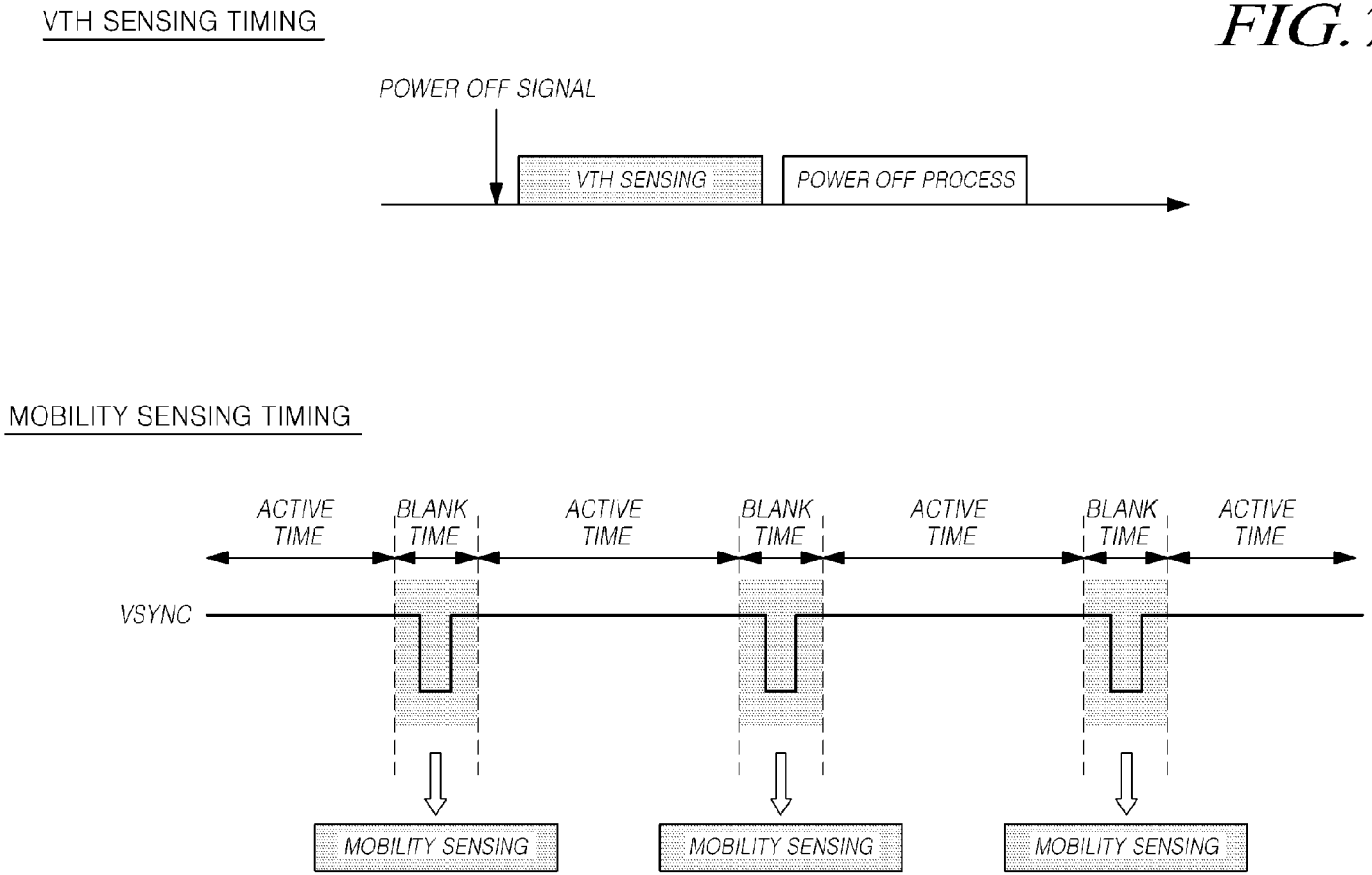
FIG. 7 is a diagram illustrating threshold voltage sensing timing and mobility sensing timing according to exemplary embodiments.

FIG. 7 is a diagram illustrating threshold voltage sensing timing and mobility sensing timing according to exemplary embodiments.

As described above, the threshold voltage sensing may take a relatively long time to be completed, as compared to the mobility sensing.

In this regard, in order to minimize user inconvenience, the threshold voltage sensing may be performed, for example, in a case in which a power off signal is input.

For example, when the power off signal is input, the threshold voltage sensing is performed on all subpixels or specific subpixels disposed in the display panel 110, and when the threshold voltage sensing is completed, a power off process, which has been performed upon generation of the power off signal, is performed. After the power off signal is input, the mobility sensing may also be performed.

Since the mobility sensing takes a relatively short time as compared to the threshold voltage sensing, the mobility sensing may be performed during screen driving.

For example, as illustrated in FIG. 7, the mobility sensing may be performed on one or more subpixel lines during a blank time section with respect to a vertical synchronization signal VSYNC. The threshold voltage sensing may also be performed on one or more subpixel lines during the blank time section, taking into account a threshold voltage sensing time.

According to the mobility sensing, a subpixel included in a corresponding subpixel line may be driven (mobility-sensing-driven) for each blank time section, and the sensing unit 310 may perform sensing processing (voltage measurement and conversion processing) for each blank time section.

As described above, since the sensing driving and the sensing processing for the mobility sensing are performed during the blank time section, the mobility sensing may be performed without greatly affecting a screen display.

As described above, even when the mobility sensing is not performed during an active time section corresponding to each frame display driving section, but during the blank time section, light may not be emitted from a subpixel line on which the mobility sensing is performed. Thus, the subpixel line (sensing subpixel line) on which the mobility sensing is performed may be viewed as a screen. This phenomenon is referred to as a "sensing subpixel line viewing phenomenon".

In order to reduce the sensing subpixel line viewing phenomenon, a plurality of subpixel lines in the display panel 110 may not be sequentially sensed, but any one selected from among the plurality of subpixel lines in the display panel 110 may be sensed.

That is, the sensing subpixel line viewing phenomenon may be reduced through a random sensing order method that changes positions of the sensing subpixel lines in the display panel 110 not sequentially but randomly.

When the mobility sensing driving and the sensing processing are performed during the blank time section, it is beneficial to perform recovery processing so that a screen displayed in an active time section before the mobility sensing driving and the sensing processing seems to be continuously displayed, even in an active time section after the mobility sensing driving and the sensing processing.

Therefore, after the mobility sensing is performed on any subpixel during the blank time section, the timing controller 140 according to exemplary embodiments may provide recovery image data (also referred to as recovery driving data) to a corresponding subpixel, the recovery image data being acquired by adding a certain value to image data (also referred to as normal driving data) in a previous active time section.

According to a difference between a time length Trcv for emission by the recovery driving data and a time length Tnrm for emission by the normal driving data, it is possible to differently determine a value to be added to the image data (normal driving data) in the previous active time section.

For example, as the difference between the time length Trcv for emission by the recovery driving data and the time length Tnrm for emission by the normal driving data increases, the value to be added to the image data (normal driving data) in the previous active time section may be reduced.

As the difference between the time length Trcv for emission by the recovery driving data and the time length Tnrm for emission by the normal driving data is reduced, the value to be added to the image data (normal driving data) in the previous active time section may be increased.

According to the image recovery processing after the mobility sensing as described above, the data driver 120 may provide a recovery image data voltage to the second node N2 of the driving transistor DRT in a frame section after the sensing processing. The recovery image data voltage is an analog voltage acquired by performing a DAC on the recovery image data (recovery driving data).

At this time, the recovery image data voltage may be a voltage acquired by adding a recovery voltage to the image data voltage provided to the second node N2 of the driving transistor DRT during a frame section before the sensing processing. The recovery voltage is a voltage corresponding to the value added to the image data (normal driving data) in the previous active time section.

As described above, after the mobility sensing during the blank time section, the image recovery processing may be performed to reduce a screen difference between frames according to the mobility sensing.

Figure 8:
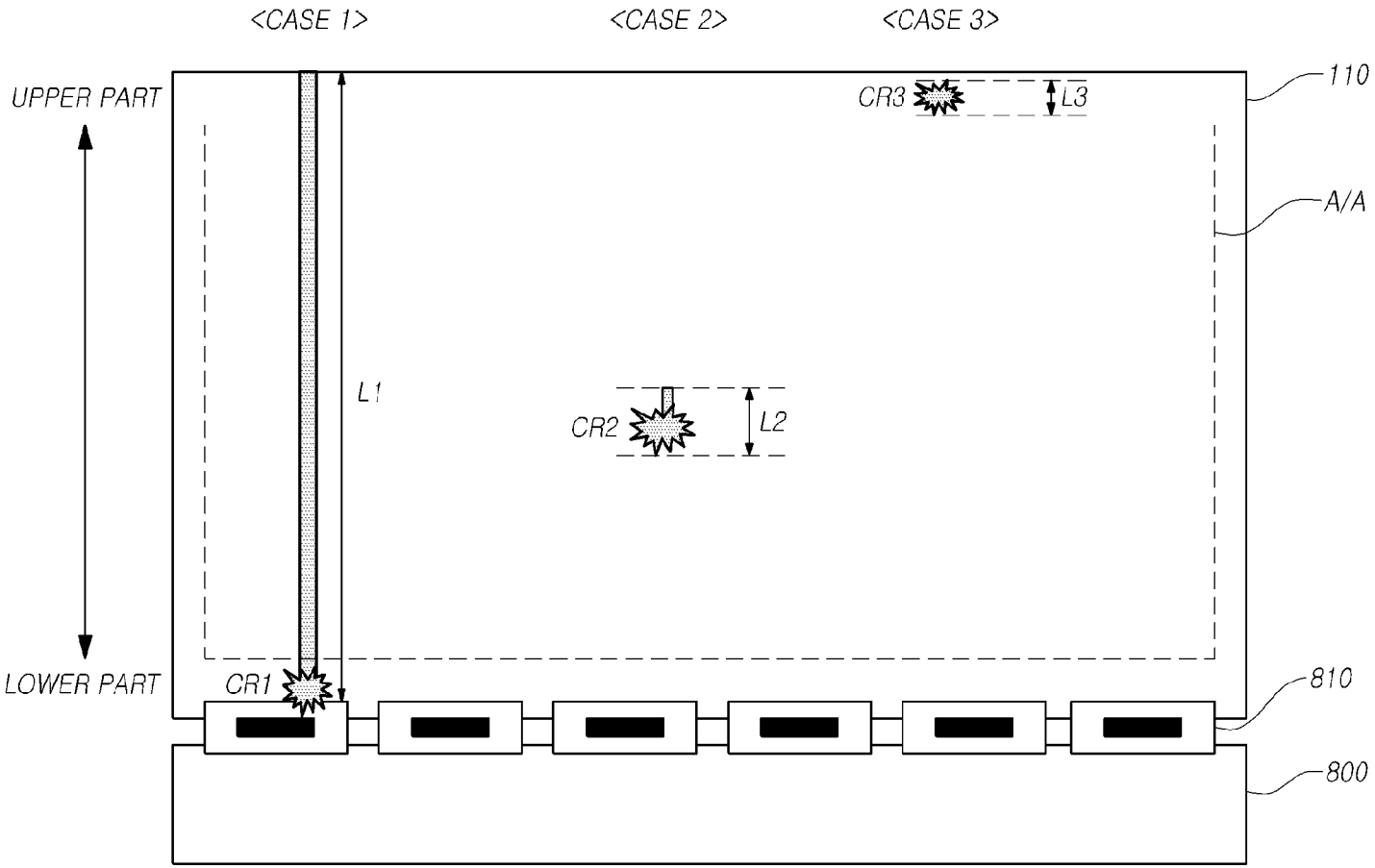
FIG. 8 is a diagram illustrating a display panel defect and an example thereof according to exemplary embodiments.

FIG. 8 is a diagram illustrating a display panel defect and an example thereof according to exemplary embodiments.

Referring to FIG. 8, the display panel 110 may include a plurality of lines, such as data lines DL1 to DLm, gate lines GL1 to GLn, a driving voltage line DVL, and a reference voltage line RVL.

In addition to these lines on the display panel 110, various circuit devices (transistors, etc.) may be electrically shorted or opened due to various factors, such as foreign substance injection and physical external forces. This phenomenon is referred to as a panel defect.

The panel defect may occur during a panel manufacturing process, or may occur due to an external impact after the shipment of the panel. In the case of a flexible display, the panel defect may occur during a panel bending process.

According to an occurrence position, an occurrence size, or an occurrence length, the case of the panel defect includes a case (Case 1) in which a defect has occurred from an occurrence point of a crack CR1 to have a length L1 much longer than a length of several hundred subpixel lines, a case (Case 2) in which a crack CR2 has occurred within an active region A/A corresponding to a screen display region of the display panel 110 to have a length L2 corresponding to a length of several tens of subpixel lines, and a case (Case 3) in which a crack CR3 occurs outside of the active region A/A of the display panel 110 to have a length L3 corresponding to a length of several subpixel lines to several tens of subpixel lines.

Hereinafter, for convenience of description of a panel defect, panel defect detection, a sensing position, and the like, a region at which the source driver integrated circuit 810 of the data driver 120 in the display panel 110 is bonded or a side where the printed circuit board 800 is disposed will be referred to as a lower part of the panel or a "lower panel part". A region or side opposite to the lower panel part will be referred to as an upper part of the panel or a "upper panel part".

Here, the upper panel part and the lower panel part are merely divided for convenience of description, and do not necessarily mean an upper side and a lower side. In some cases, the upper panel part and the lower panel part may respectively mean a lower side and an upper side, may respectively mean a left side and a right side, or may respectively mean a right side and a left side.

When the above-described panel defect has occurred, the display panel 110 may malfunction, or a screen abnormality may occur. In severe cases, the display panel 110 may be burnt, and thus, the display panel 110 may be discarded.

Therefore, exemplary embodiments may provide a method and a configuration for detecting a panel defect and protect the panel from being burnt. In particular, exemplary embodiments may provide a method capable of improving panel defect detection performance.

Exemplary embodiments may provide a method and a configuration for detecting the panel defect using a sensing value obtained through a sensing operation (threshold voltage sensing operation, mobility sensing operation, or the like).

According to exemplary embodiments, the sensing operation may include the threshold voltage sensing operation and the mobility sensing operation. The sensing operation may include "sensing driving" of driving a corresponding subpixel so that the voltage at the first node N1 of the driving transistor DRT is in a voltage state capable of reflecting a threshold voltage or mobility of the driving transistor DRT, and "sensing processing" of sampling the voltage at the first node N1 of the driving transistor DRT, i.e., a voltage charged in the line capacitor Cline on the sensing line RVL and measuring (sensing) the sampled voltage, the voltage at the first node N1 of the driving transistor DRT reflects the threshold voltage or the mobility of the driving transistor DRT.

Hereinafter, a method and a configuration for detecting a panel defect using a sensing operation will be described. For convenience of description, the sensing operation used in the panel defect detection is taken as a sensing operation (mobility sensing operation and threshold voltage sensing operation) which may be performed during the blank time section, but the present discloses are not limited thereto.

Figure 9:
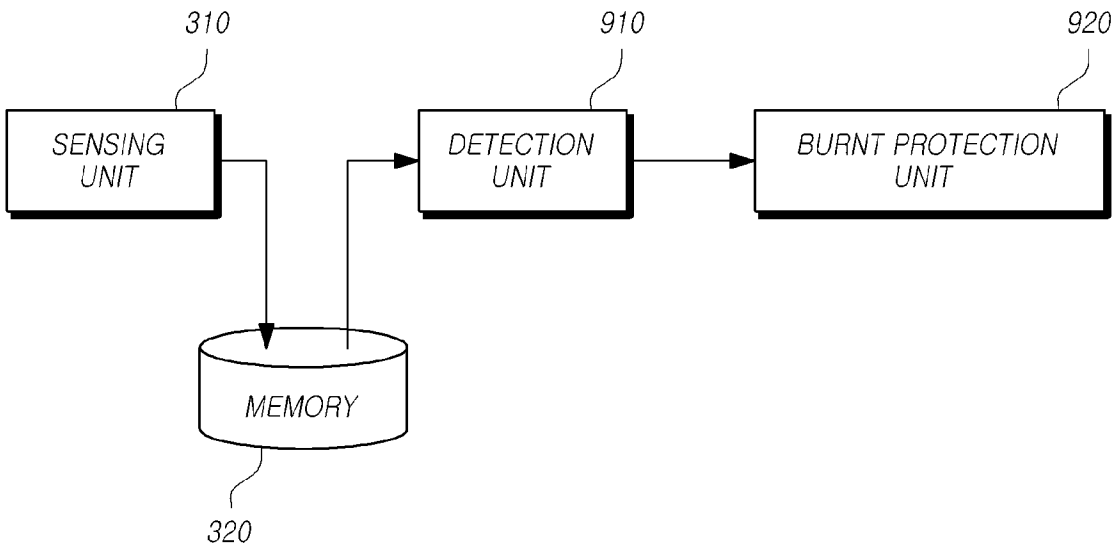
FIG. 9 is a block diagram illustrating a configuration for detecting a panel defect and protecting a panel from being burnt according to exemplary embodiments.

FIG. 9 is a block diagram illustrating a configuration for detecting a panel defect and protecting the panel from being burnt according to exemplary embodiments.

Referring to FIG. 9, in order for the panel defect detection and the panel burning protection to be undertaken, the organic light-emitting display device 100 according to exemplary embodiments includes a sensing unit 310, a memory 320, a detection unit 910, a panel burning protection unit 920, and the like.

The sensing unit 310 performs sensing processing of sensing a voltage on a sensing line RVL and outputting a sensing voltage, the sensing line RVL being electrically connected to a first node N1 of a driving transistor DRT within a subpixel on a sensing subpixel line SSPL of a plurality of subpixel lines in a display panel 110.

The sensing unit 310 may perform sensing processing on each of sensing subpixel lines as many as the predetermined number of sensing subpixel lines in specific regions according to a sequential order or a random order.

For example, when sensing processing is performed on 35 subpixel lines (sensing subpixel lines SSPL 1-1 to SSPL 1-35 as many as the number of the sensing subpixel lines) in an upper panel region (of specific regions) including 50 subpixel lines, the sensing processing may be downwardly or upwardly performed on the 35 subpixel lines according to a sequential order (for example, an order of SSPL 1-1→SSPL 1-2→ . . . →SSPL 1-35), or may be performed on the 35 subpixel lines according to a random order (for example, an order of SSPL 1-3→SSPL 1-10→SSPL 1-5→ . . . →SSPL 1-22).

Here, a sensing value may be a value sensed for the mobility sensing, and may also be a value sensed for the threshold voltage sensing. In some cases, the sensing value may be a deterioration sensing value of an OLED.

The memory 320 stores SSPL-specific sensing values in an amount equal to the predetermined number (N) of the sensing subpixel lines in at least one of specific regions in the display panel 110. Here, the number (N) of the sensing subpixel lines may be equal to or less than the total number of the subpixel lines (subpixel row). For detection efficiency, the number (N) of the sensing subpixel lines may be set to be a value less than the total number of the subpixel lines (subpixel row).

The detection unit 910 may detect a display defect based on the SSPL-specific sensing values in an amount equal to the number (N) of the sensing subpixel lines stored in the memory 320, i.e., the SSPL-specific sensing values in an amount equal to the predetermined number (N) of the sensing subpixel lines in at least one of specific regions in the display panel 110.

Here, the at least one of specific regions may be at least one of a first panel region (for example, an upper panel region), a second panel region (for example, a lower panel region), and a third panel region (for example, a central panel region).

Hereinafter, for convenience of description, the first panel region will be referred to as the upper panel region, the second panel region will be referred to as the lower panel region, and the third panel region will be referred to as the central panel region.

As described above, the panel defect may be detected using an operation of sensing subpixel characteristic values, such as the mobility, the threshold voltage, and the like, of the driving transistor DRT, thereby detecting the panel defect without a separate dedicated circuit or component for panel defect detection.

When the detection unit 910 detects that a panel defect of the display panel 110 has occurred, the panel burning protection unit 920 may store at least one of a code value (for example, one or zero) and position information about defect detection (for example, identification information about a subpixel line, a coordinate value on a panel, or the like) based on the defect detection result, or may cut off the power of the display panel 110.

Therefore, when the panel defect has occurred, panel burning caused by the panel defect may be prevented in advance by cutting off the power of the display panel 110. In addition, when the panel burning protection unit 920 stores the position information about the defect detection (for example, the identification information about the subpixel line, the coordinate value on the panel, or the like), at the time of repairing the display panel 110, it is possible to easily and accurately detect a position in which the panel defect has occurred, thereby easily repairing the display panel 110.

The detection unit 910 and the panel burning protection unit 920 may be included inside of the timing controller 140. In some cases, the detection unit 910 and the panel burning protection unit 920 may be included outside of the timing controller 140, and be included inside of the data driver 120.

Figure 10:
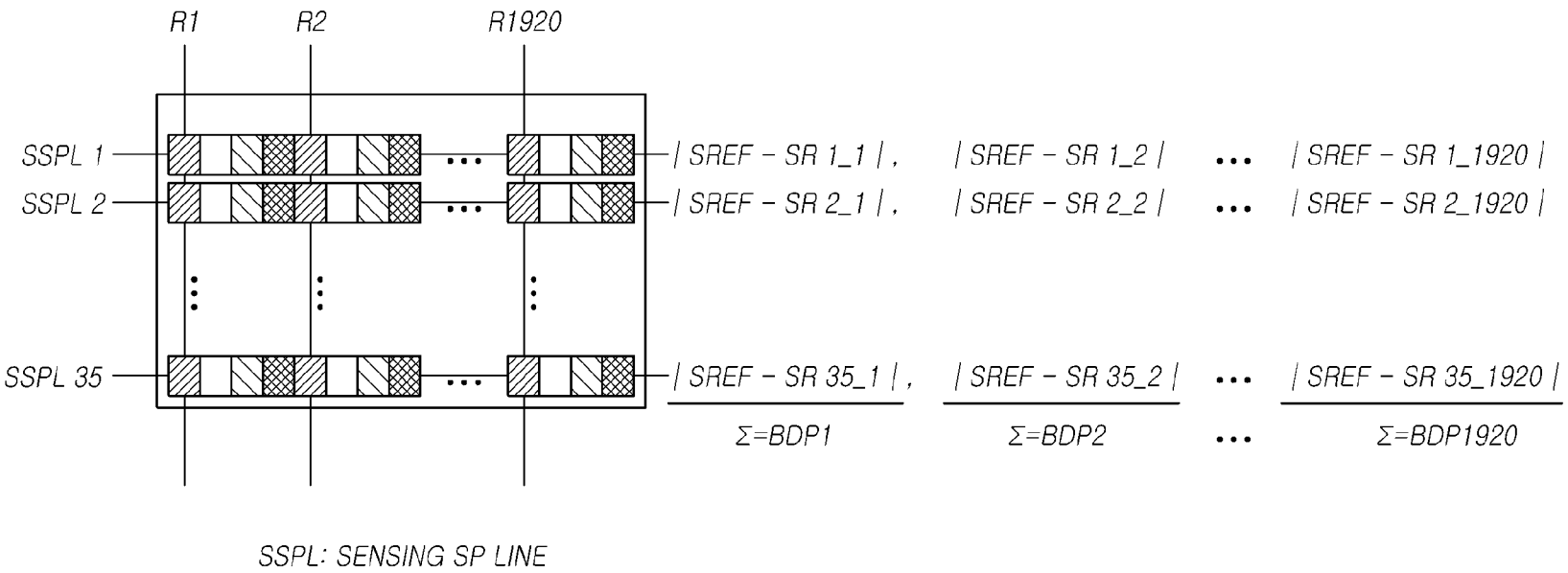
FIG. 10 is a diagram illustrating a panel defect detection method according to exemplary embodiments.

FIG. 10 is a diagram illustrating a panel defect detection method according to exemplary embodiments.

Referring to FIG. 10, a detection unit 910 may calculate a difference value between a value obtained by adding up all sensing values according to sensing subpixel lines SSPL in an amount equal to the predetermined number (N, i.e., N=35) of the sensing subpixel lines, and a value obtained by multiplying the predetermined number (N) of the sensing subpixel lines by a predetermined normal sensing value. When the calculated difference value exceeds a predetermined threshold value, the detection unit 910 may detect that a panel defect of a display panel 110 has occurred. The sensing subpixel lines SSPL in an amount equal to the number (N, e.g., N=35) of the sensing subpixel lines are referred to as a group of sensing subpixel lines or a "sensing subpixel line group."

According to the above-described calculation of the panel defect detection, the panel defect may be rapidly and efficiently detected.

Hereinafter, the panel defect detection method will be described, by way of example, in more detail with reference to FIG. 10. In the case that an organic light-emitting display device 100 has an RWGB pixel structure, 1,920 pixel columns (i.e., 4×1,920 subpixel columns) exist, and the number (N) of the sensing subpixel lines is 35. In addition, sensing processing is taken as being performed on a red subpixel but the present discloses are not limited thereto.

In FIG. 10, R1, R2, . . . , R1920 indicate red subpixel columns, respectively. SSPL 1, SSPL 2, . . . , SSPL 35 indicate 35 sensing subpixel lines, respectively.

In addition, SR 1_1, SR 1_2, . . . , SR 1_1920 respectively indicate sensing values according to 1,920 red subpixels in SSPL 1. SR 2_1, SR 2_2, . . . , SR 2_1920 respectively indicate sensing values according to 1,920 red subpixels in SSPL 2. SR 35_1, SR 35_2, . . . , SR 35_1920 respectively indicate sensing values according to 1,920 red subpixels in SSPL 3.

All of difference values between the sensing values and predetermined normal sensing values SREF are added up, and the added value (BDP1+BDP2+ . . . +BDP1920) may be compared with a predetermined threshold value. When the added value (BDP1+BDP2+ . . . +BDP1920) exceeds the predetermined threshold value, it may be detected that the panel defect of the display panel 110 has occurred.

As the threshold value is set to a small value, panel defects may all be detected, but a detection situation, in which a panel defect is mistakenly detected, may increase. On the contrary, as the threshold value is set to a large value, the detection situation, in which a panel defect is mistakenly detected, may decrease, but a situation, in which an actual panel defect is not detected, may increase.

Therefore, taking into account the accuracy and the efficiency of panel defect detection performance, it is beneficial to precisely set the threshold value.

The panel defect may occur in any position of the display panel 110, but, due to characteristics of the organic light-emitting display device 100 or structural characteristics of a system, the possibility of the panel defect may relatively increase on a thin portion of the display panel 110, a peripheral portion of the display panel 110, and an edge of the display panel 110.

Hereinafter, a panel defect detection method will be described with reference to FIGS. 11 to 13 without taking into account the possibility of a panel defect for each position.

Next, an accurate and efficient panel defect detection method will be described with reference to FIGS. 14 to 22 by taking into account the possibility of a panel defect in each position.

Figure 11:
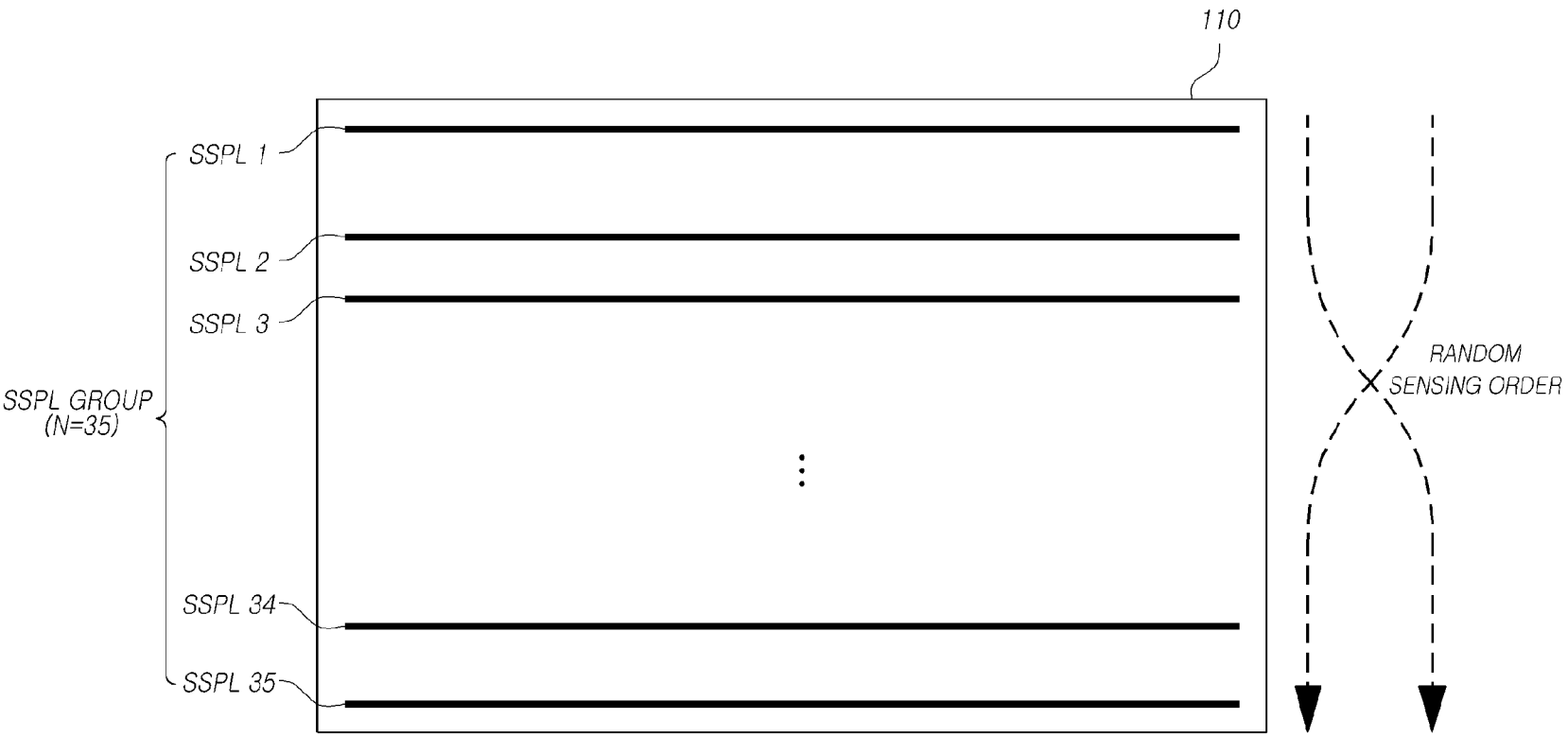
FIG. 11 is an exemplary diagram illustrating the position and the sensing order of a group of sensing subpixel lines in sensing processing performed through a first sensing method according to exemplary embodiments.

FIG. 11 is an exemplary diagram illustrating the position and the sensing order of a sensing subpixel line (SSPL) group in sensing processing performed through a first sensing method according to exemplary embodiments.

Referring to FIG. 11, the SSPL group may exist in all regions of a display panel 110, the SSPL group including sensing subpixel lines SSPL 1 to SSPL 35 in an amount equal to the number (N) of sensing subpixel lines for one panel defect detection processing in sensing processing performed through the first sensing method according to exemplary embodiments.

Referring to FIG. 11, the sensing subpixel lines SSPL in an amount equal to the number (N) of the sensing subpixel lines are subpixel lines in an amount equal to the number (N) of the sensed sensing subpixel lines, randomly selected from among a plurality of subpixel lines to be sensed.

The sensing order of the sensing subpixel lines SSPL in an amount equal to the number (N) of the sensing subpixel lines is not a sequential order, but is a random order.

Therefore, it is possible to reduce a sensing subpixel line viewing phenomenon.

After sensing driving is performed on the sensing subpixel lines SSPL in an amount equal to the number (N) of the sensing subpixel lines, randomly selected from among all regions of the display panel 110, a sensing unit 310 may perform sensing processing on the sensing subpixel lines SSPL in an amount equal to the number (N) of the sensing subpixel lines, randomly selected from among all regions of the display panel 110.

A detection unit 910 may perform panel defect detection processing with respect to the presence or absence of the panel defect in all regions of the display panel 110 based on SSPL-specific sensing values in an amount equal to the number (N) of the sensing subpixel lines, selected from among all regions of the display panel 110.

According to the above-described first sensing method, the panel defect detection processing may be performed by performing the sensing driving and the sensing processing on all subpixel lines within the display panel 110.

The sensing driving, the sensing processing, and the panel defect detection processing may be performed for each color.

For example, the sensing driving, the sensing processing, and the panel defect detection processing may be performed on a red subpixel. The sensing driving, the sensing processing, and the panel defect detection processing may be performed on a white subpixel. The sensing driving, the sensing processing, and the panel defect detection processing may be performed on a green subpixel. The sensing driving, the sensing processing, and the panel defect detection processing may be performed on a blue subpixel.

Figure 12:
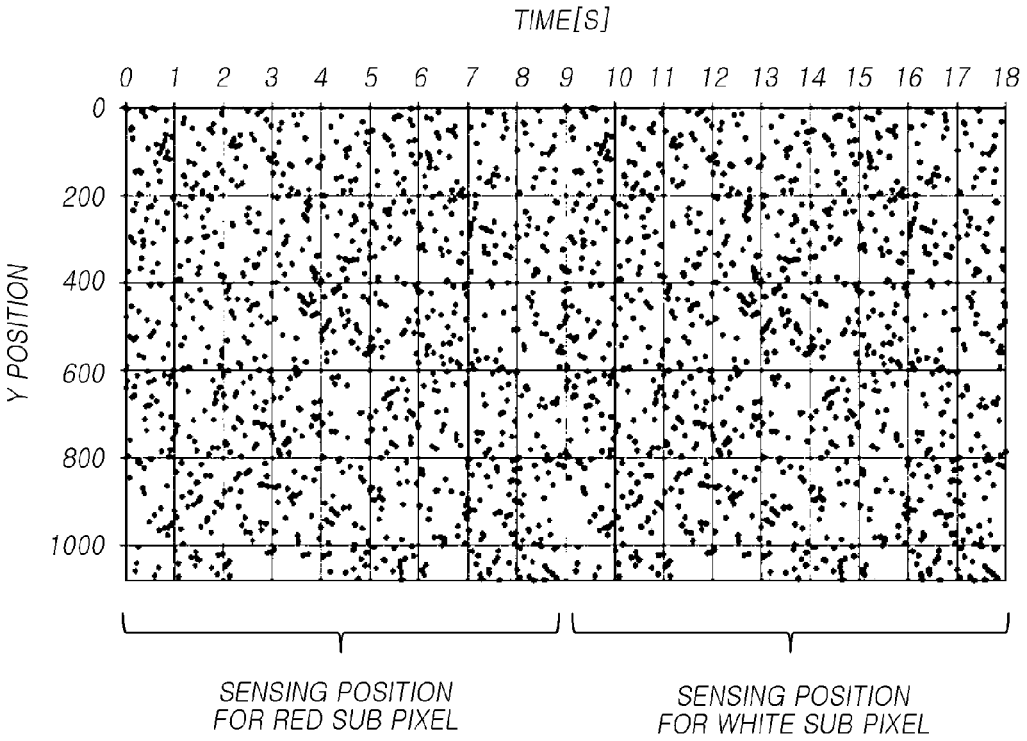
FIG. 12 is a diagram illustrating a sensing position according to time in sensing processing performed through the first sensing method according to exemplary embodiments.

FIG. 12 is a diagram illustrating a sensing position according to time in sensing processing performed through the first sensing method according to exemplary embodiments.

FIG. 12 illustrates a position in which sensing driving and sensing processing are performed on a first subpixel (red subpixel), and a position in which sensing driving and sensing processing are performed on a second subpixel (white subpixel). It may be confirmed that sensing positions are uniformly distributed in all regions of the display panel 110.

In a case in which the panel defect of the display panel 110 is detected using the sensing processing performed through the first sensing method described above, regarding the panel defect detection performance, in the case that that the number (N) of the sensing subpixel lines is considerably less than the number of all subpixel lines, according to the first sensing method, after the sensing driving and the sensing processing are performed on the sensing subpixel lines SSPL in an amount equal to the number (N) of the sensing subpixel lines, randomly selected from among all regions of the display panel 110, the panel defect detection processing may be performed, but the present disclosures are not limited thereto. Thus, among the sensing values according to the sensing subpixel lines in an amount equal to the number (N) of the sensing subpixel lines, the possibility of a trouble sensing value may decrease. Accordingly, even when the panel defect actually exists, it is highly probable that the panel defect will not be detected.

Figure 13:
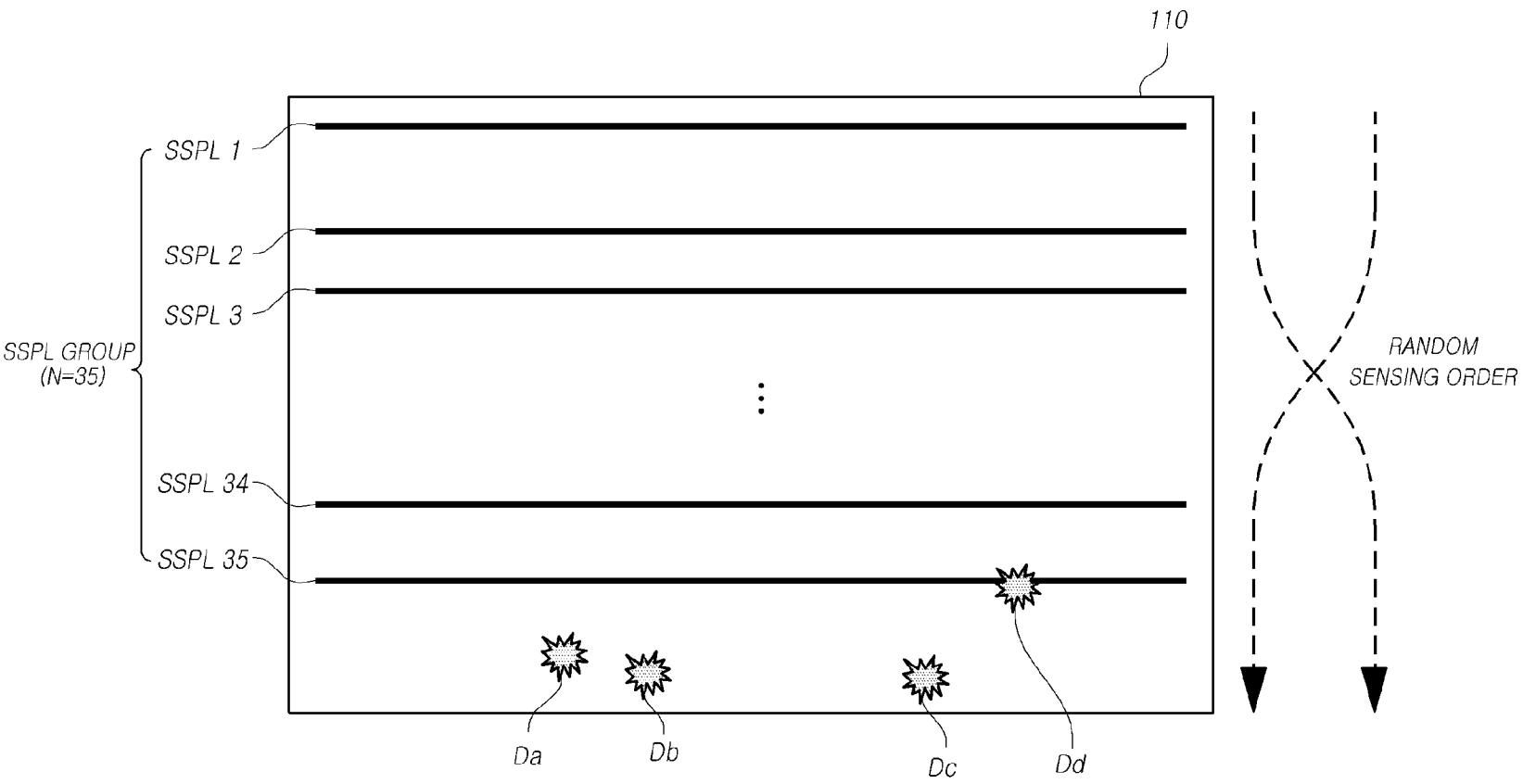
FIG. 13 is a diagram illustrating panel defect detection performance when a display panel defect is detected using sensing processing performed through the first sensing method according to exemplary embodiments.

FIG. 13 is a diagram illustrating panel defect detection performance when a display panel defect is detected using sensing processing performed through the first sensing method according to exemplary embodiments.

Referring to FIG. 13, when the sensing driving and the sensing processing are performed through the first sensing method according to exemplary embodiments, a plurality of panel defects Da, Db, Dc, Dd, . . . actually exist in the display panel 110, but it is highly probable that a position of the panel defect will not be sensed, or only a small number of the panel defects is be sensed.

Therefore, according to the panel defect detection method described above with reference to FIG. 10, when the position of the panel defect is not sensed, or only a small number of the panel defects is sensed, it may be finally determined that the panel defect does not exist. In particular, it is highly probable that the panel defect will not be detected in Case 2 and Case 3 in FIG. 8.

That is, when the panel defect is detected using the first sensing method, the accuracy of the detection may be considerably low.

This is because the sensing subpixel lines in an amount equal to the number (N) of the predetermined sensing subpixel lines are selected from among all regions of the display panel 110 without taking into account the possibility of the panel defect for each position.

Figure 14:
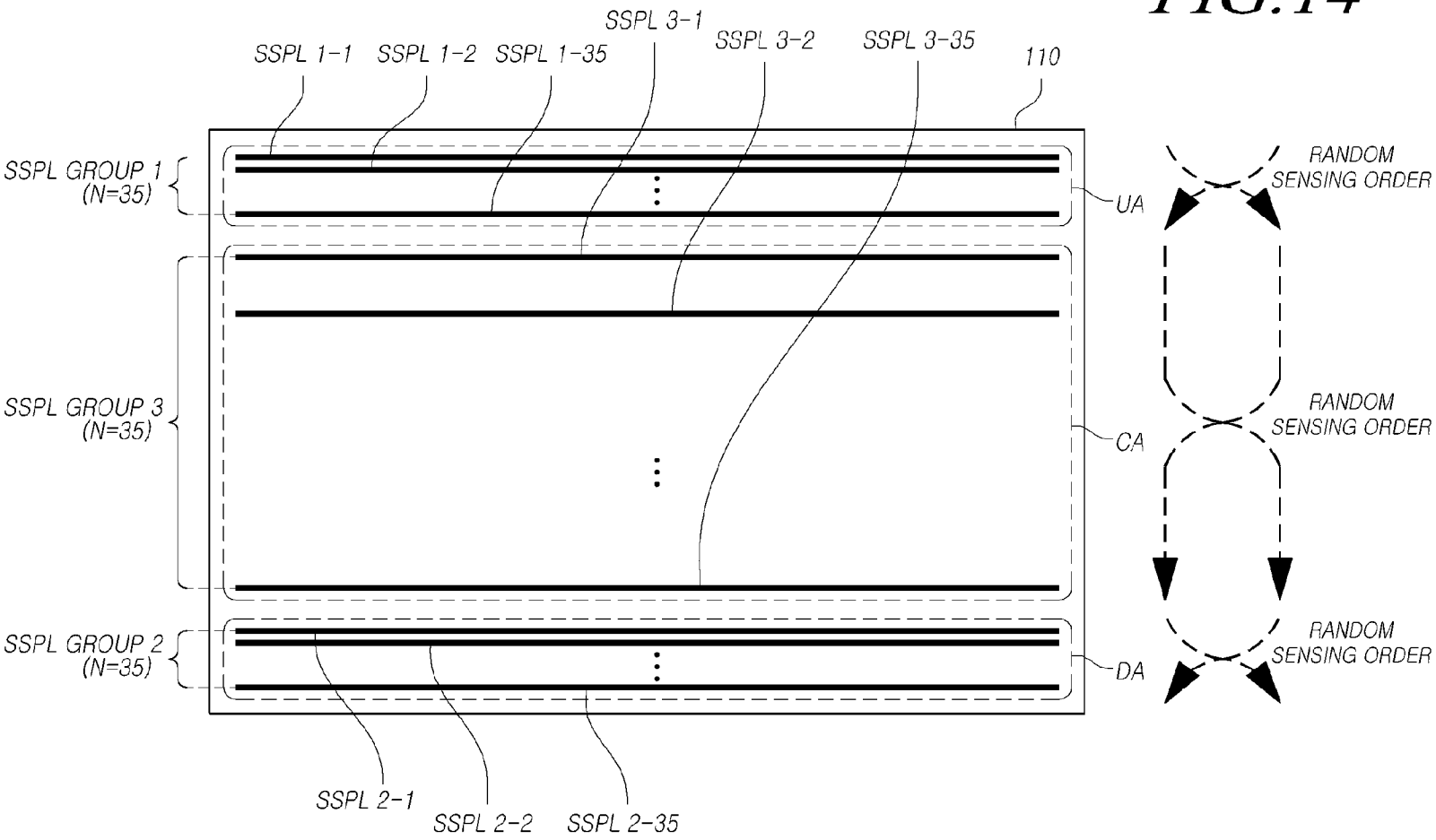
FIG. 14 is an exemplary diagram illustrating positions and a sensing order of groups of sensing subpixel lines in sensing processing performed through a second sensing method according to exemplary embodiments.
Figure 15:
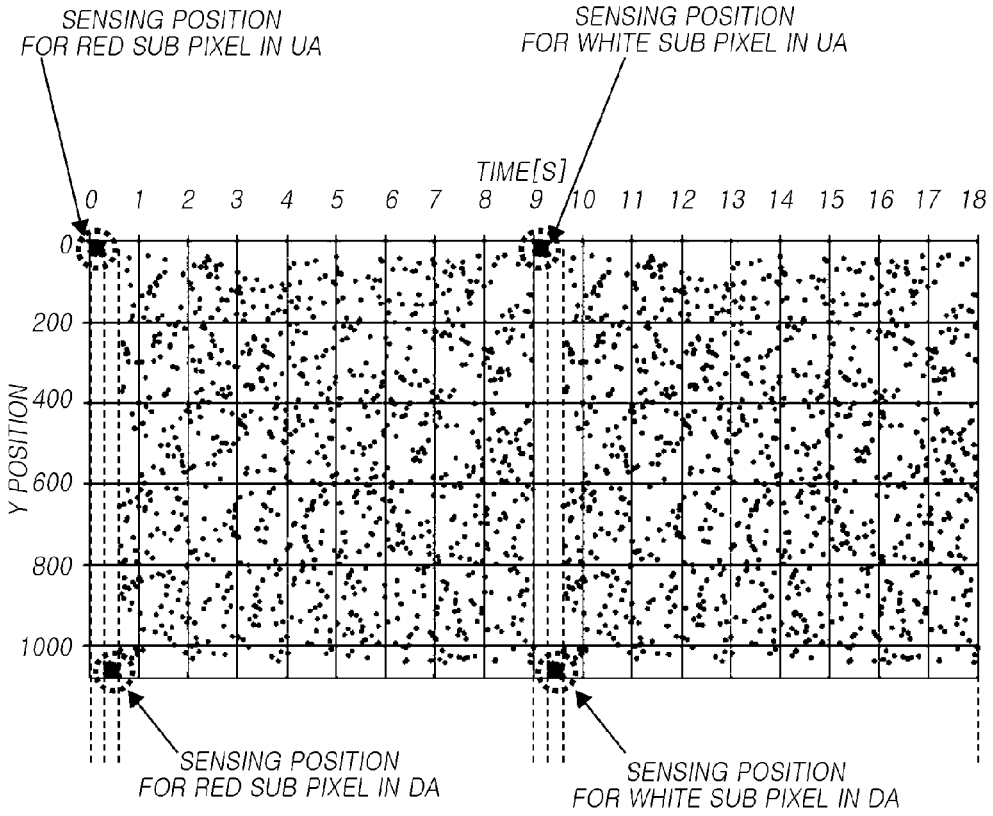
FIG. 15 is a diagram illustrating a sensing position according to time in sensing processing performed through the second sensing method according to exemplary embodiments.
Figure 16:
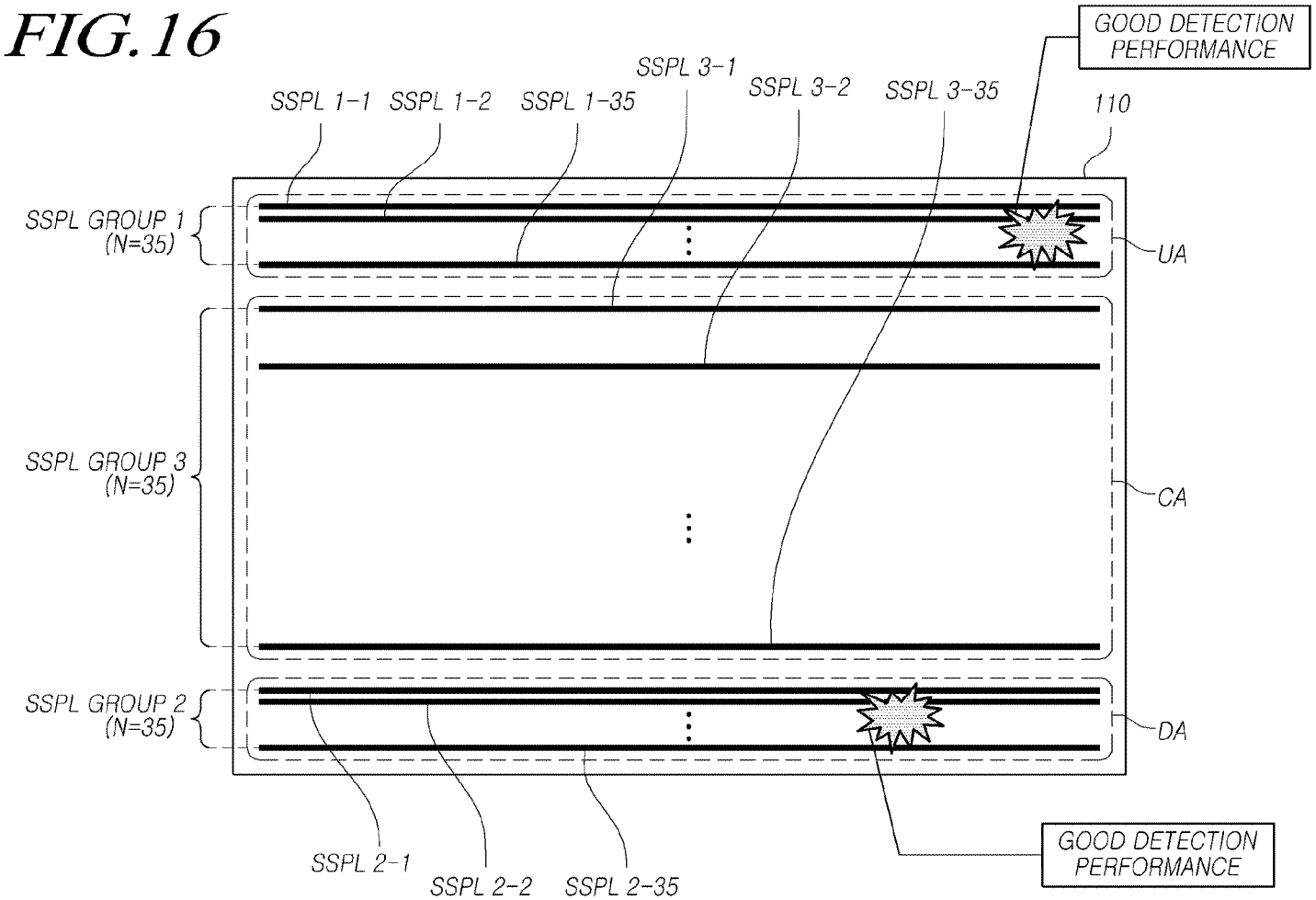
FIG. 16 is a diagram illustrating panel defect detection performance when a display panel defect is detected using sensing processing performed through the second sensing method according to exemplary embodiments.

FIG. 14 is an exemplary diagram illustrating the positions and the sensing order of groups of sensing subpixel lines (sensing subpixel line groups) Group 1, Group 2, and Group 3 in sensing processing performed through a second sensing method according to exemplary embodiments. FIG. 15 is a diagram illustrating a sensing position according to time in sensing processing performed through the second sensing method according to exemplary embodiments. FIG. 16 is a diagram illustrating panel defect detection performance when a display panel defect is detected using sensing processing performed through the second sensing method according to exemplary embodiments.

Referring to FIG. 14, in the case of the second sensing method according to exemplary embodiments, panel defect detection processing is primarily performed by performing a sensing operation (sensing driving and sensing processing) on the SSPL Group 1 in an upper panel region UA or the SSPL Group 2 in a lower panel region DA.

When the panel defect is not detected in the upper panel region UA or the lower panel region DA, panel defect detection processing is secondarily performed by performing a sensing operation (sensing driving and sensing processing) on the SSPL Group 2 in the lower panel region DA or the SSPL Group 1 in the upper panel region UA.

When the panel defect is not detected in the lower panel region DA or the upper panel region UA, panel defect detection processing is finally performed by performing a sensing operation (sensing driving and sensing processing) on the SSPL Group 3 in a central panel region CA. In some cases, the sensing operation (sensing driving and sensing processing) and the panel defect detection processing may not be performed on the SSPL Group 3 in the central panel region CA.

According to the second sensing method, the sensing subpixel lines in an amount equal to the number (N) of the sensing subpixel lines used in one panel defect detection may include only subpixel lines SSPL 1-1 to SSPL 1-35 in an amount equal to the number (N) of the sensing subpixel lines, selected from among a plurality of subpixel lines in the upper panel region UA, include only subpixel lines SSPL 2-1 to SSPL 2-35 in an amount equal to the number (N) of the sensing subpixel lines, selected from among a plurality of subpixel lines in the lower panel region DA, or include only subpixel lines SSPL 3-1 to SSPL 3-35 in an amount equal to the number (N) of the sensed sensing subpixel lines, randomly selected from among a plurality of subpixel lines in the central panel region CA.

Therefore, the panel defect may be detected for each panel region.

In addition, the sensing operation and the panel defect detection processing may be primarily performed in the upper panel region UA or the lower panel region DA, in which the probability of the panel defect is relatively high, thereby more rapidly detecting the panel defect.

A sensing unit 310 may perform upper panel part sensing processing on the sensing subpixel lines SSPL 1-1 to SSPL 1-35 in an amount equal to the number of the sensing subpixel lines in the upper panel region UA, perform lower panel part sensing processing on the sensing subpixel lines SSPLs SSPL 2-1 to SSPL 2-35 in an amount equal to the number of the sensing subpixel lines in the lower panel region DA, and perform central panel part sensing processing on the sensing subpixel lines SSPL 3-1 to SSPL 3-35 in an amount equal to the number (N) of the sensing subpixel lines in the central panel region CA according to a set sensing order.

The sensing unit 310 may primarily perform one of the upper panel part sensing processing in the upper panel region UA and the lower panel part sensing processing in the lower panel region DA, secondarily perform the other, and finally perform the central panel part sensing processing in the central panel region CA (UA⇒DA⇒CA or DA⇒UA⇒CA).

In an example, referring to FIG. 15 illustrating a sensing position according to time, a sensing operation in the upper panel region UA may be intensively performed between about zero seconds and about 0.3 seconds, a sensing operation in the lower panel region DA may be intensively performed between about 0.3 seconds and about 0.6 seconds, and a sensing operation in the central panel region CA may be less intensively performed between about 0.6 seconds and about 9 seconds. Here, the term "intensively" means that a ratio of subpixel lines (sensing subpixel lines) to all subpixel lines in a relevant region is high and low, a sensing operation being actually performed on the subpixel lines (sensing subpixel lines) for one panel defect detection processing. A high ratio means that a sensing operation is intensively performed, and a low ratio means that a sensing operation is less intensively performed.

As described above, since the sensing operation is primarily performed in the upper panel region UA or the lower panel region DA, in which the probability of the panel defect is relatively high, the panel defect can be detected using the sensing result. Accordingly, the panel defect may be more accurately and more rapidly detected.

A detection unit 910 may perform upper panel part defect detection processing with respect to the presence or absence of a defect in the upper panel region UA of the display panel 110 based on SSPL-specific sensing values of the sensing subpixel lines SSPL 1-1 to SSPL 1-35 in an amount equal to the number (N, e.g., N=35) of the sensing subpixel lines in the upper panel region UA. The detection unit 910 may perform lower panel part defect detection processing with respect to the presence or absence of a defect in the lower panel region DA of the display panel 110 based on SSPL-specific sensing values of the sensing subpixel lines SSPL 2-1 to SSPL 2-35 in an amount equal to the number (N, e.g., N=35) of the sensing subpixel lines in the lower panel region DA. The detection unit 910 may perform central panel part defect detection processing with respect to the presence or absence of a defect in the central panel region CA of the display panel 110 based on SSPL-specific sensing values of the sensing subpixel lines SSPL 3-1 to SSPL 3-35 in an amount equal to the number (N, e.g., N=35) of the sensing subpixel lines in the central panel region CA.

As illustrated in FIGS. 15 and 16, the sensing operation and the panel defect detection processing are primarily and intensively performed in the upper panel region UA or the lower panel region DA, in which the probability of the panel defect is relatively high, thereby more rapidly and more accurately detecting the panel defect.

The number of the subpixel lines disposed in the upper panel region UA or the lower panel region DA is equal to or slightly greater than the number (N) of the sensing subpixel lines. In comparison, the number of the subpixel lines disposed in the central panel region CA is much greater than the number (N) of the sensing subpixel lines.

For example, in the case of a resolution of 1,920×1,080, when the total number of the subpixel lines in the display panel 110 is 1,080, and the number (N) of the sensing subpixel lines is 35, the upper panel region UA may be set as a region in which 35 subpixel lines are disposed from an upper panel end, and the lower panel region DA may be set as a region in which 35 subpixel lines are disposed from a lower panel end. Accordingly, the 35 subpixel lines disposed in each of the upper panel region UA and the lower panel region DA may all become the sensing subpixel line. 1,010 (=1,080−35−35) subpixel lines are disposed in the central panel region CA, and only 35 subpixel lines of the 1,010 subpixel lines become the sensing subpixel line.

That is, a size of each of the upper panel region UA and the lower panel region DA is much less than a size of the central panel region CA.

Therefore, since the sensing operation in the upper panel region UA is performed on all or most of subpixel lines within the upper panel region UA, the panel defect actually within the upper panel region UA can be detected, or it is highly probable that the panel defect will be detected.

In the same manner, since the sensing operation in the lower panel region DA is performed on all or most of subpixel lines within the lower panel region DA, the panel defect actually within the lower panel region DA is necessarily detected, or it is highly probable that the panel defect will be detected.

As described above, as illustrated in FIGS. 15 and 16, since the sensing operation is intensively performed in the upper panel region UA or the lower panel region DA, in which the probability of the panel defect is high, all or most of the subpixel lines within the upper panel region UA and the lower panel region DA may be sensed as the sensing subpixel line. Accordingly, the panel defect detection performance may be high.

In particular, it is highly probable that the panel defect will be detected in Case 1, Case 2, and Case 3 in FIG. 8.

As illustrated in FIG. 15, since the sensing operation is performed in the upper panel region UA and the lower panel region DA before the central panel region CA, the panel defect may be more rapidly detected.

A sensing order of sensing processing with respect to the sensing subpixel lines SSPL 1-1 to SSPL 1-35 in an amount equal to the number (N) of the sensing subpixel lines in the upper panel region UA may be selected in random order. For example, the sensing operation may be performed in a random order, such as SSPL 2, SSPL 14, SSPL 32, . . . , SSPL 17.

In the same manner, a sensing order of sensing processing with respect to the sensing subpixel lines SSPL 2-1 to SSPL 2-35 in an amount equal to the number (N) of the sensing subpixel lines in the lower panel region DA may be selected in random order.

In the same manner, a sensing order of sensing processing with respect to the sensing subpixel lines SSPL 3-1 to SSPL 3-35 in an amount equal to the number (N) of the sensing subpixel lines in the central panel region CA may be selected in random order.

Since the sensing order of the sensing processing with respect to the sensing subpixel lines in an amount equal to the predetermined number (N) of the sensing subpixel lines in one sensing subpixel group is selected as the random order, it is possible to considerably reduce a sensing subpixel line viewing phenomenon.

Hereinafter, a third sensing method, in which a probability of a panel defect is structurally high in an upper panel region UA, and a probability of a panel defect is structurally relatively low in the remaining region, will be described.

The upper panel region UA in the third sensing method may be substantially the same as the upper panel region UA in the second sensing method, and a lower panel region DA in the third sensing method may be a panel region in which the central panel region CA and the lower panel region DA in the second sensing method are added up.

Figure 17:
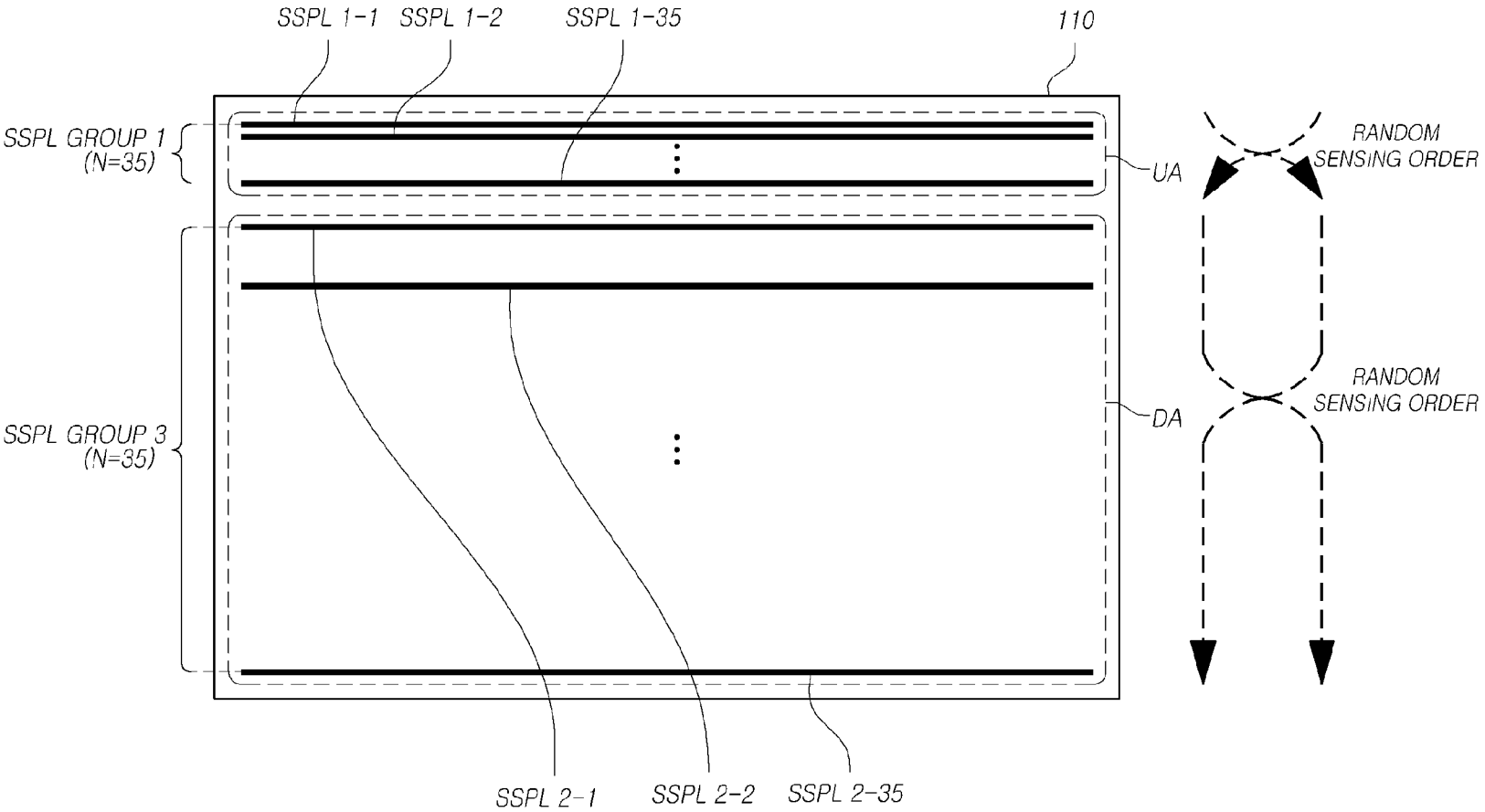
FIG. 17 is an exemplary diagram illustrating the position and the sensing order of a group of sensing subpixel lines in sensing processing performed through a third sensing method according to exemplary embodiments.
Figure 18:
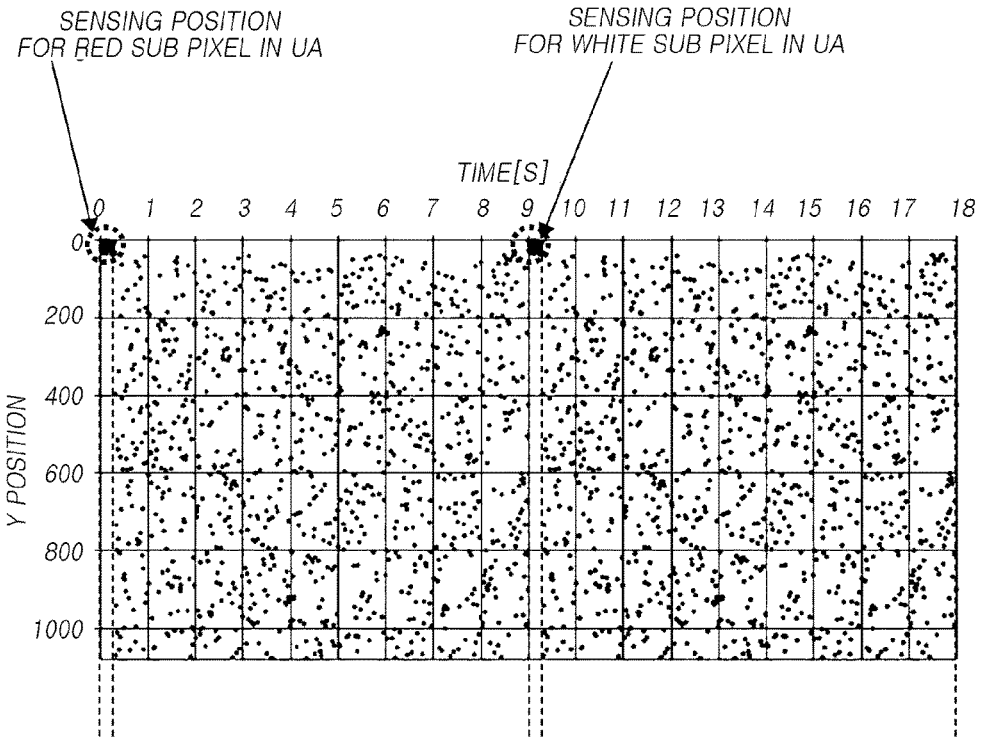
FIG. 18 is a diagram illustrating a sensing position according to time in sensing processing performed through the third sensing method according to exemplary embodiments.
Figure 19:
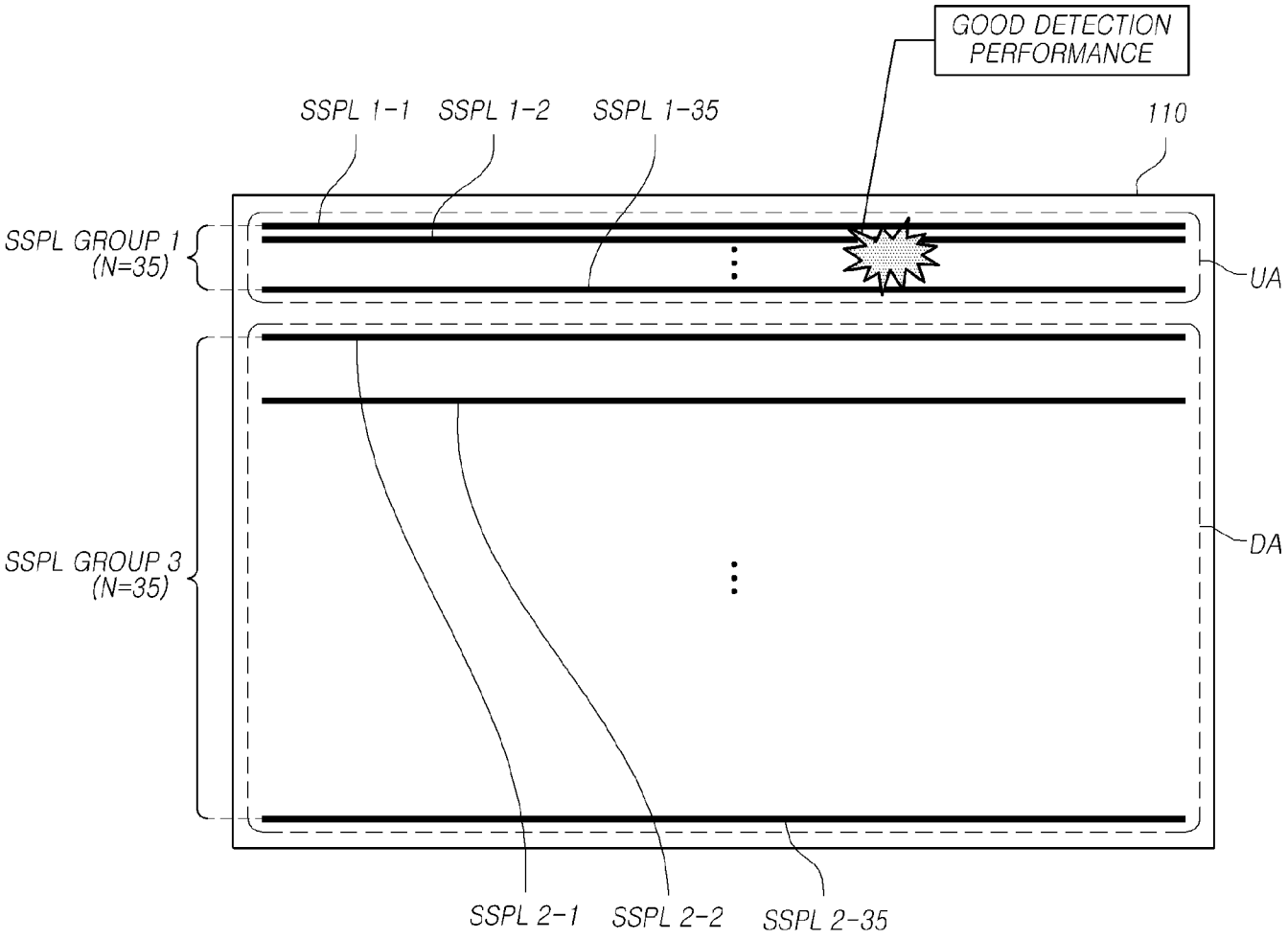
FIG. 19 is a diagram illustrating detection panel defect performance when a display panel defect is detected using sensing processing performed through the third sensing method according to exemplary embodiments.

FIG. 17 is an exemplary diagram illustrating the positions and the sensing order of groups of sensing subpixel lines (sensing subpixel line groups) Group 1 and Group 2 in sensing processing performed through the third sensing method according to exemplary embodiments. FIG. 18 is a diagram illustrating a sensing position according to time in sensing processing performed through the third sensing method according to exemplary embodiments. FIG. 19 is a diagram illustrating panel defect detection performance when a display panel defect is detected using sensing processing performed through the third sensing method according to exemplary embodiments.

Referring to FIG. 17, in the case of the third sensing method according to exemplary embodiments, panel defect detection processing is primarily performed by performing a sensing operation (sensing driving and sensing processing) on the SSPL Group 1 in the upper panel region UA.

When the panel defect is not detected in the upper panel region UA, panel defect detection processing is finally performed by performing a sensing operation (sensing driving and sensing processing) on the SSPL Group 2 in the lower panel region DA.

Therefore, sensing subpixel lines in an amount equal to the number (N) of sensing subpixel lines used in one panel defect detection may include only subpixel lines SSPL 1-1 to SSPL 1-35 in an amount equal to the number (N) of the sensing subpixel lines, selected from among a plurality of subpixel lines in the upper panel region UA, or include only subpixel lines SSPL 2-1 to SSPL 2-35 in an amount equal to the number (N) of the sensing subpixel lines, selected from among a plurality of subpixel lines in the lower panel region DA.

As described above, the sensing operation and the panel defect detection processing may be primarily performed in the upper panel region UA, in which the probability of the panel defect is relatively high, thereby more rapidly detecting the panel defect.

A sensing unit 310 may perform upper panel part sensing processing on the sensing subpixel lines SSPL 1-1 to SSPL 1-35 in an amount equal to the number of the sensing subpixel lines in the upper panel region UA, and perform lower panel part sensing processing on the sensing subpixel lines SSPL 2-1 to SSPL 2-35 in an amount equal to the number of the sensing subpixel lines in the lower panel region DA according to a set sensing order.

The sensing unit 310 may primarily perform the upper panel part sensing processing in the upper panel region UA, and finally perform the lower panel part sensing processing in the lower panel region DA (UA⇒DA).

As described above, since the sensing operation is primarily performed in the upper panel region UA, in which the probability of the panel defect is relatively high, the panel defect may be detected using the sensing result. Accordingly, the panel defect may be more accurately and rapidly detected.

A detection unit 910 may perform upper panel part defect detection processing with respect to the presence or absence of a defect in the upper panel region UA of the display panel 110 based on sensing values according to the sensing subpixel lines SSPL 1-1 to SSPL 1-35 an many as to the number (N, e.g., N=35) of the sensing subpixel lines in the upper panel region UA. The detection unit 910 may perform lower panel part defect detection processing with respect to the presence or absence of a defect in the lower panel region DA of the display panel 110 based on SSPL-specific sensing values of the sensing subpixel lines SSPL 2-1 to SSPL 2-35 in an amount equal to the number (N, e.g., N=35) of the sensing subpixel lines in the lower panel region DA.

As illustrated in FIGS. 18 and 19, the sensing operation and the panel defect detection processing may be primarily and intensively performed in the upper panel region UA, in which the probability of the panel defect is relatively high, thereby more rapidly and more accurately detecting the panel defect.

The number of the subpixel lines disposed in the upper panel region UA is equal to or slightly greater than the number (N) of the sensing subpixel lines. In comparison, the number of the subpixel lines disposed in the lower panel region DA is much greater than the number (N) of the sensing subpixel lines.

For example, in the case of a resolution of 1,920×1,080, when the total number of subpixel lines in the display panel 110 is 1,080, and the number (N) of the sensing subpixel lines is 35, the upper panel region UA may be set as a region in which 35 subpixel lines are disposed from an upper panel end. Accordingly, the 35 subpixel lines disposed in the upper panel region UA may all become the sensing subpixel line. 1,045 (=1,080−35−35) subpixel lines are disposed in the lower panel region DA corresponding to the remaining region, and only 35 subpixel lines of the 1,045 subpixel lines become the sensing subpixel line.

That is, a size of the upper panel region UA is much less than a size of the lower panel region DA.

Therefore, since the sensing operation in the upper panel region UA is performed on all or most of subpixel lines within the upper panel region UA, the panel defect actually within the upper panel region UA is necessarily detected, or it is highly probable that the panel defect will be detected.

In particular, it is highly probable that the panel defect will be detected in Case 1, Case 2, and Case 3 in FIG. 8.

As described above, as illustrated in FIGS. 18 and 19, since the sensing operation is intensively performed in the upper panel region UA, in which the probability of the panel defect is high, all or most of the subpixel lines within the upper panel region UA may be sensed as the sensing subpixel line. Accordingly, the panel defect detection performance may be high.

As illustrated in FIG. 18, since the sensing operation is performed in the upper panel region UA before the lower panel region DA, the panel defect may be more rapidly detected.

A sensing order of sensing processing with respect to the sensing subpixel lines SSPL 1-1 to SSPL 1-35 in an amount equal to the number (N) of the sensing subpixel lines may be selected in random order. For example, the sensing operation may be performed in a random order, such as SSPL 2, SSPL 14, SSPL 32, . . . , SSPL 17.

In the same manner, a sensing order of sensing processing with respect to the sensing subpixel lines SSPL 2-1 to SSPL 2-35 in an amount equal to the number (N) of the sensing subpixel lines in the lower panel region DA may be selected as a random manner.

Since the sensing order of the sensing processing with respect to the sensing subpixel lines in an amount equal to the predetermined number (N) of the sensing subpixel lines in one sensing subpixel group is selected as the random order, it is possible to considerably reduce a sensing subpixel line viewing phenomenon.

Figure 20:
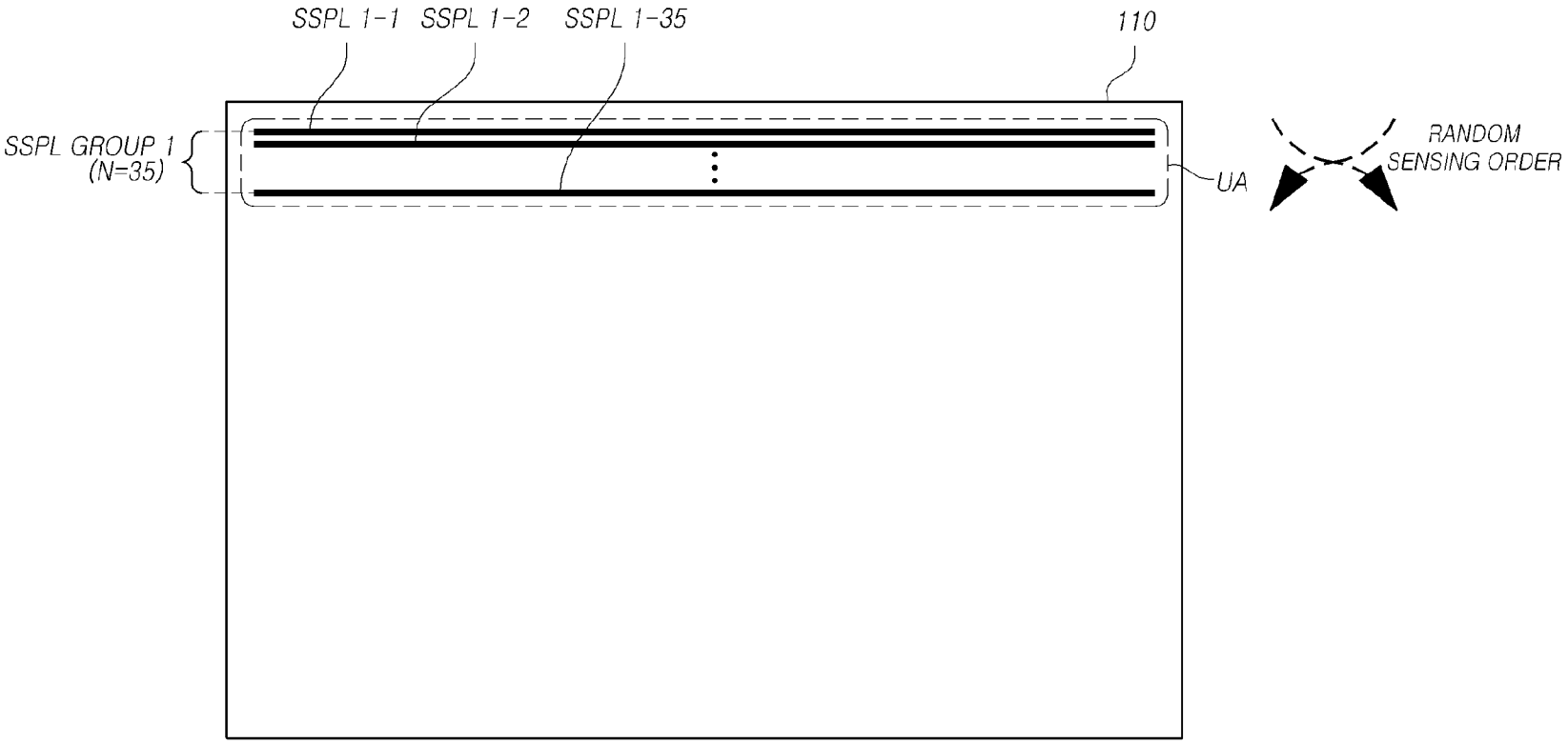
FIG. 20 is an exemplary diagram illustrating the position of a group of sensing subpixel lines and panel defect detection performance in sensing processing performed through a fourth sensing method according to exemplary embodiments.

FIG. 20 is an exemplary diagram illustrating the position of a sensing subpixel line group Group 1 and panel defect detection performance in sensing processing performed through a fourth sensing method according to exemplary embodiments.

Referring to FIG. 20, in the case of the fourth sensing method according to exemplary embodiments, after a sensing operation (sensing driving and sensing processing) is performed on sensing subpixel lines SSPL 1-1 to SSPL 1-35 in an amount equal to the number (N) of sensing subpixel lines in an upper panel region UA, in which a detection probability of the panel defect is high, in order for efficiency, the sensing operation may not be performed on the remaining regions excluding the upper panel region UA.

Figure 21:
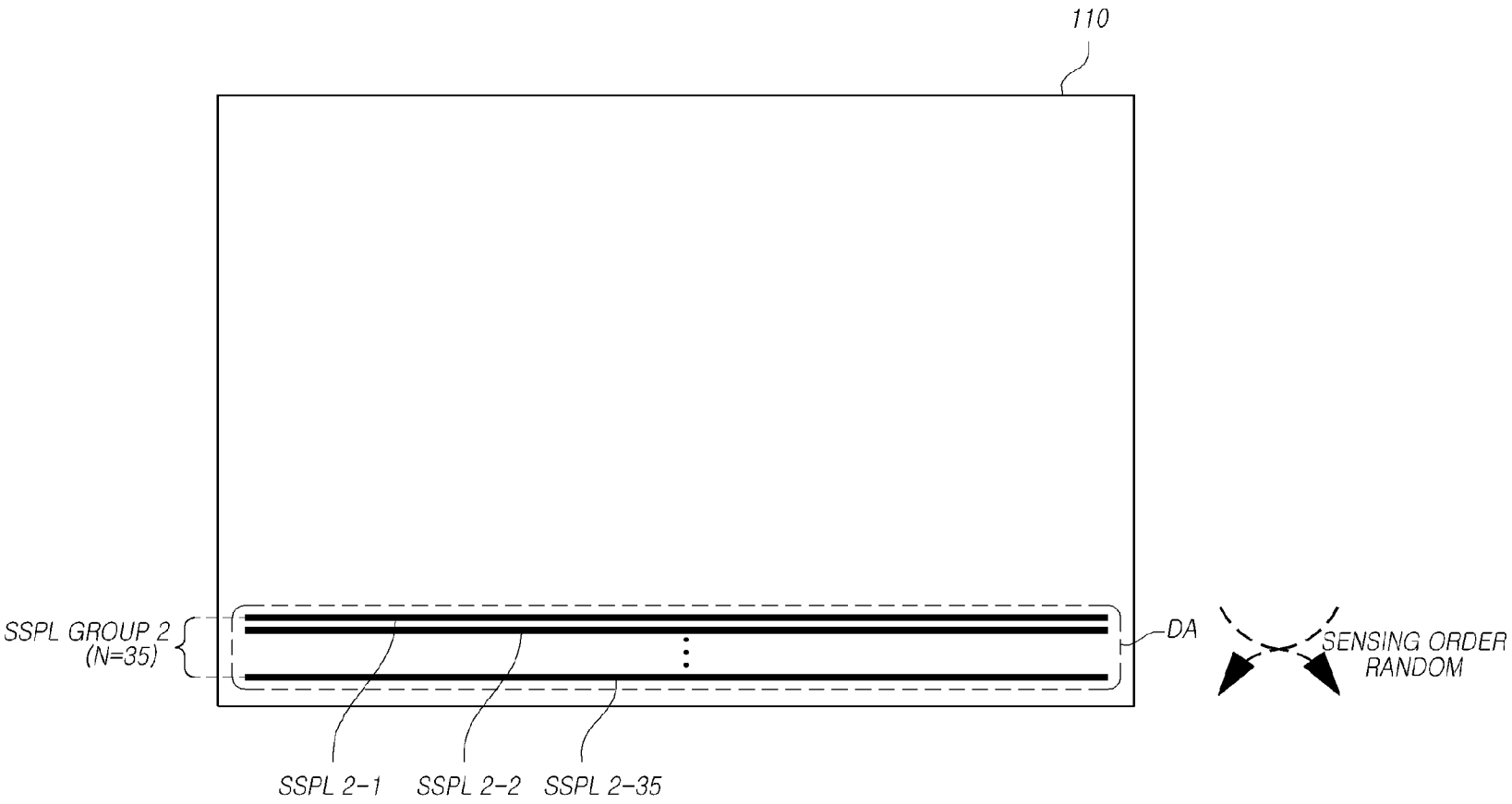
FIG. 21 is an exemplary diagram illustrating the position of a group of sensing subpixel lines and panel defect detection performance in sensing processing performed through a fifth sensing method according to exemplary embodiments.

FIG. 21 is an exemplary diagram illustrating the position of a sensing subpixel line group Group 2 and panel defect detection performance in sensing processing performed through a fifth sensing method according to exemplary embodiments.

Referring to FIG. 21, in the case of the fifth sensing method according to exemplary embodiments, after a sensing operation (sensing driving and sensing processing) is performed on sensing subpixel lines SSPL 2-1 to SSPL 2-35 in an amount equal to the number (N) of sensing subpixel lines in a lower panel region DA, in which a detection probability of the panel defect is high, in order for efficiency, the sensing operation may not be performed on the remaining regions excluding the lower panel region DA.

Figure 22:
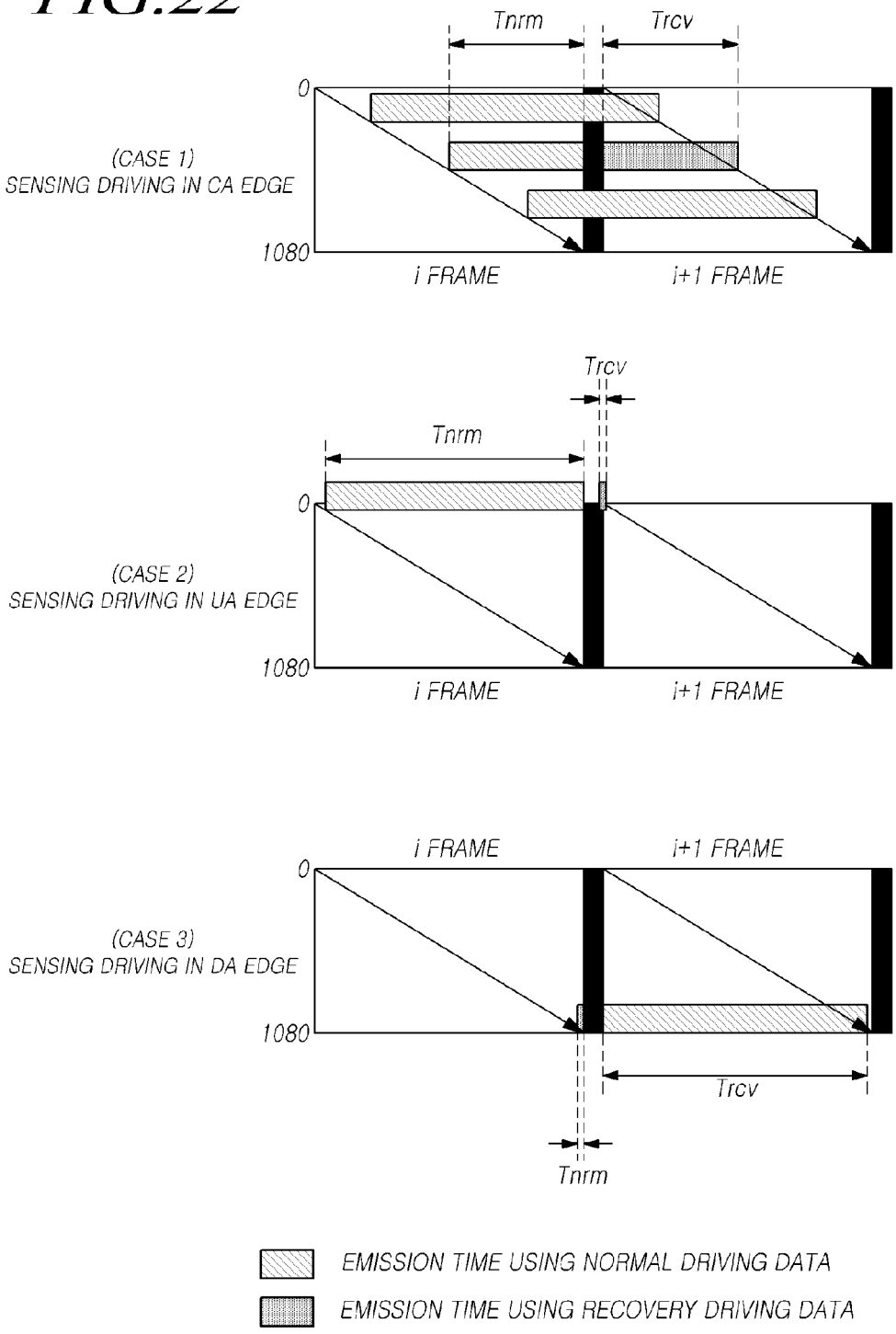
FIG. 22 is a diagram illustrating an emission state according to a sensing performing position in sensing processing according to exemplary embodiments.

FIG. 22 is a diagram illustrating an emission state according to a sensing performing position in sensing processing according to exemplary embodiments.

Referring to FIG. 22, the organic light-emitting display device 100 according to exemplary embodiments may perform image driving on an i frame during an active time section, and perform sensing driving and sensing processing during a blank time section. After the blank time section, image driving is performed on an i+1 frame during a next active time section.

Referring to FIG. 22, before and after a sensing operation during the blank time section, it is beneficial to perform an image recovery processing so as to reduce a screen difference between frames.

Therefore, after the sensing operation is performed during the blank time section, in order to perform the image driving on the i−1 frame, a timing controller 140 according to exemplary embodiments may provide recovery image data (referred to as recovery driving data) to a relevant subpixel, the recovery image data being acquired by adding a recovery amount to image data (referred to as normal driving data) for the i frame in a previous active time section.

Here, according to a difference between a time length Trcv for emission using the recovery driving data and a time length Tnrm for emission using the normal driving data, it is possible to differently determine the recovery amount to be added to the image data (normal driving data) in the previous active time section.

For example, as the difference increases between the time length Trcv for emission using the recovery driving data and the time length Tnrm for emission using the normal driving data, the recovery amount to be added to the image data (normal driving data) in the previous active time section may be reduced.

As the difference is reduced between the time length Trcv for emission using the recovery driving data and the time length Tnrm for emission using the normal driving data, the recover amount to be added to the image data (normal driving data) in the previous active time section may be increased.

The recovery amount may be in inverse proportion to the difference between the time length Trcv for emission using the recovery driving data and the time length Tnrm for emission using the normal driving data.

As the difference is reduced, the recovery amount increases. That is, as the difference is reduced, the recovery driving data becomes greater than the normal driving data.

As the difference increases, the recovery amount is reduced. That is, as the difference increases, the recovery driving data becomes equal to the normal driving data.

Referring to FIG. 22, in Case 1 wherein a subpixel line in a central panel region CA is sensed, since the difference is small between the time length Trcv for emission using the recovery driving data and the time length Tnrm for emission using the normal driving data, the recovery amount may be increased. Accordingly, the recovery driving data may have a data value greater than a data value of the normal driving data.

Referring to FIG. 22, in Case 2 wherein an uppermost subpixel line in an upper panel region UA is sensed, since the time length Trcv for emission using the recovery driving data is much shorter than the time length Tnrm for emission using the normal driving data, that is, the difference becomes much larger between the time length Trcv for emission using the recovery driving data and the time length Tnrm for emission using the normal driving data, the recovery amount may become much smaller. Accordingly, the normal driving data may be equal or almost equal to the recovery driving data.

Referring to FIG. 22, in Case 3 wherein a lowermost subpixel line in a lower panel region DA is sensed, since the time length Trcv for emission using the recovery driving data is much longer than the time length Tnrm for emission using the normal driving data, that is, the difference becomes much larger between the time length Trcv for emission using the recovery driving data and the time length Tnrm for emission using the normal driving data, the recovery amount may become much smaller. Accordingly, the normal driving data may be equal or almost equal to the recovery driving data.

As described above, when the sensing operation for the panel defect detection according to exemplary embodiments is primarily performed in the upper panel region UA or the lower panel region DA, the recovery driving data may become equal to the normal driving data. Accordingly, it may be unnecessary to apply an algorithm for separately calculating the recovery amount.

FIG. 23 is a flowchart of a panel defect detection method according to exemplary embodiments.

The panel defect detection method according to exemplary embodiments may include, when sensing driving is performed on subpixels on sensing subpixel lines of a plurality of subpixel lines, and characteristic values, such as mobility and a threshold voltage of a driving transistor DRT, within each of the subpixels are to be sensed, performing sensing processing of sensing a voltage on a sensing line RVL and outputting a sensing value by a sensing unit 310, the sensing line RVL being electrically connected to a first node N1 of the driving transistor DRT within each of the subpixels on the sensing subpixel lines of the plurality of subpixel lines; and detecting a panel defect based on the sensing value according to each of sensing subpixel lines in an amount equal to the predetermined number (N) of sensing subpixel lines.

The sensing subpixel lines in an amount equal to the number of the sensing subpixel lines, on which a sensing operation for one panel sensing defect detection is performed, may be a subpixel line in an upper panel region UA or a lower panel region DA.

Taking into account that the upper panel region UA or the lower panel region DA is a region in which the probability of the panel defect is high, a sensing operation or a panel defect detection operation are primarily performed in the upper panel region UA or the lower panel region DA.

In this case, the panel defect detection method according to exemplary embodiments will be described below with reference to FIG. 23.

Referring to FIG. 23, sensing processing of sensing a voltage on a sensing line RVL and outputting a sensing value is performed, the sensing line RVL being electrically connected to a first node N1 of a driving transistor DRT within each of subpixels on sensing subpixel lines in an amount equal to the number (N) of sensing subpixel lines in the upper panel region UA (S2300).

After the sensing processing (S2300), a panel defect in the upper panel region UA is detected based on the SSPL-specific sensing values in an amount equal to the number (N) of the sensing subpixel lines in the upper panel region UA, the sensing value being obtained in the sensing processing (S2300) (S2302).

It is determined based on the defect detection result in the upper panel region UA in the defect detecting (S2302) whether the panel defect is present within in the upper panel region UA (S2304).

When it is determined that the panel defect is present within in the upper panel region UA, panel defect protection processing is performed (S2318).

When it is determined that the panel defect does not exist in the upper panel region UA, sensing processing of sensing a voltage on a sensing line RVL and outputting a sensing value is performed, the sensing line RVL being electrically connected to a first node N1 of a driving transistor DRT within each of subpixels on sensing subpixel lines in an amount equal to the number (N) of the sensing subpixel lines in the lower panel region DA (S2306).

After the sensing processing (S2306), a panel defect in the lower panel region DA is detected based on the SSPL-specific sensing values in an amount equal to the number (N) of the sensing subpixel lines in the lower panel region DA, the sensing value being obtained in the sensing processing (S2306) (S2308).

It is determined based on the defect detection result in the lower panel region DA in the defect detecting (S2308) whether the panel defect is present within in the lower panel region DA (S2310).

When it is determined that the panel defect is present within in the lower panel region DA, the panel defect protection processing is performed (S2318).

When it is determined that the panel defect does not exist in the lower panel region DA, sensing processing of sensing a voltage on a sensing lines RVL and outputting a sensing value is performed, the sensing line RVL being electrically connected to a first node N1 of a driving transistor DRT within each of subpixels on sensing subpixel lines in an amount equal to the number (N) of the sensing subpixel lines in a central panel region CA (S2312).

After the sensing processing (S2312), a panel defect in the central panel region CA is detected based on the SSPL-specific sensing value in an amount equal to the number (N) of the sensing subpixel lines in the central panel region CA, the sensing value being obtained in the sensing processing (S2312) (S2314).

When it is determined that the panel defect is present within in the central panel region CA, the panel defect protection processing is performed (S2318).

The sensing processing (S2300), the sensing processing (S2306), and the sensing processing (S2312) may be sensing processing performed for each blank time section.

The number of the subpixel lines disposed in the upper panel region UA or the lower panel region DA of a display panel 110 is equal to or slightly greater than the number (N) of the sensing subpixel lines. In comparison, the number of the subpixel lines disposed in the central panel region CA may be much greater than the number (N) of the sensing subpixel lines.

In the upper panel region UA and the lower panel region DA, a ratio of the subpixel lines (sensing subpixel lines) to all subpixel lines may be within a range between a predetermined specific ratio (for example, 30% to 80%) and 100%, a sensing operation being performed on the subpixel lines (sensing subpixel lines).

In the central panel region CA, a ratio of the subpixel lines (sensing subpixel lines) to all subpixel lines may be within a range between a predetermined specific ratio (for example, 30%) and 100%, a sensing operation being performed on the subpixel lines (sensing subpixel lines).

As described above, according to exemplary embodiments, it is possible to provide an efficient display panel defect detection method and an efficient organic light-emitting display device 100.

According to exemplary embodiments, it is possible to provide the method and the organic light-emitting display device 100 able to detect a panel defect without a separate circuit and component for panel defect detection.

According to exemplary embodiments, it is possible to provide the method and the organic light-emitting display device 100 able to more accurately and more rapidly detect a panel defect without a separate circuit and component for panel defect detection.

According to exemplary embodiments, it is possible to provide the method and the organic light-emitting display device 100 able to detect a panel defect using a sensing value compensating for subpixel characteristic values.

According to exemplary embodiments, it is possible to provide the method and the organic light-emitting display device 100 able to rapidly detect a panel defect by primarily sensing a region having the high probability of the panel defect when a sensing operation for the panel defect detection is performed.

According to exemplary embodiments, it is possible to provide the method and the organic light-emitting display device 100 able to improve the detection accuracy of the panel defect by intensively sensing a region having the high probability of the panel defect when a sensing operation for the panel defect detection is performed.

The foregoing descriptions and the accompanying drawings have been presented in order to explain the certain principles of the present disclosure. A person skilled in the art to which the disclosure relates can make many modifications and variations by combining, dividing, substituting for, or changing the elements without departing from the principle of the disclosure. The foregoing embodiments disclosed herein shall be interpreted as illustrative only but not as limitative of the principle and scope of the disclosure. It should be understood that the scope of the disclosure shall be defined by the appended Claims and all of their equivalents fall within the scope of the disclosure.

What is claimed is:

1. An organic light-emitting display device comprising:

a display panel in which subpixels are disposed in a matrix, each subpixel including an organic light-emitting diode and a driving transistor;

a sensing unit that senses a voltage on a sensing line and outputs a sensing value, the sensing line being electrically connected to a first node of a driving transistor in each subpixel on sensing subpixel lines corresponding to subpixel lines to be sensing-driven among a plurality of subpixel lines; and a detection unit that detects a panel defect on the display panel based on sensing values according to the sensing subpixel lines in an amount equal to a predetermined number of sensing subpixel lines in at least one of predetermined regions in the display panel, wherein at least two subpixels on one of the sensing subpixel lines are electrically connected to different sensing lines.

2. The organic light-emitting display device according to claim 1, wherein the sensing unit performs a sensing processing on each of the sensing subpixel lines in an amount equal to the number of the sensing subpixel lines in the at least one of predetermined regions according to a sequential order or a random order.

3. The organic light-emitting display device according to claim 1, wherein the at least one of predetermined regions is at least one of an upper panel region, a lower panel region, and a central panel region.

4. The organic light-emitting display device according to claim 1, wherein the detection unit calculates a difference value between a value obtained by adding up all sensing values according to the sensing subpixel lines in an amount equal to the number of the sensing subpixel lines and a value obtained by multiplying the number of the sensing subpixel lines by a predetermined normal sensing value, and when the calculated difference value exceeds a predetermined threshold value, the detection unit detects that the panel defect has occurred.

5. The organic light-emitting display device according to claim 1, further comprising a panel burning protection unit which, when the detection unit detects that the panel defect of the display panel has occurred, stores at least one of a code value or position information about defect detection based on the defect detection result, or cuts off the power of the display panel.

6. The organic light-emitting display device according to claim 1, wherein the sensing unit performs, in a set order, a first panel region sensing processing on sensing subpixel lines in an amount equal to the number of the sensing subpixel lines in a first panel region, a second panel region sensing processing on sensing subpixel lines in an amount equal to the number of the sensing subpixel lines in a second panel region, and a third panel region sensing processing on sensing subpixel lines in an amount equal to the number of the sensing subpixel lines in a third panel region, and the detection unit performs a first panel region defect detection processing of detecting a defect in the first panel region based on a sensing value according to each of the sensing subpixel lines in an amount equal to the number of the sensing subpixel lines in the first panel region, a second panel region defect detection processing of detecting a defect in the second panel region based on a sensing value according to each of the sensing subpixel lines in an amount equal to the number of the sensing subpixel lines in the second panel region, and a third panel region defect detection processing of detecting a defect in the third panel region based on a sensing value according to each of the sensing subpixel lines in an amount equal to the number of the sensing subpixel lines in the third panel region.

7. The organic light-emitting display device according to claim 6, wherein a ratio of the sensing subpixel lines to all subpixel lines is within a range between a predetermined ratio and 100% in the first panel region and the second panel region, and a ratio of the sensing subpixel lines to the all subpixel lines is less than the predetermined specific ratio in the third panel region.

8. The organic light-emitting display device according to claim 6, wherein the sensing unit primarily performs one of the first panel region sensing processing and the second panel region sensing processing, secondarily performs the other, and finally performs the third panel region sensing processing.

9. The organic light-emitting display device according to claim 1, wherein the sensing unit performs, in set order, a first panel region sensing processing on sensing subpixel lines in an amount equal to the number of the sensing subpixel lines in a first panel region, and a second panel region sensing processing on sensing subpixel lines in an amount equal to the number of the sensing subpixel lines in a second panel region excluding the first panel region, and the detection unit performs a first panel region defect detection processing of detecting a defect in the first panel region based on a sensing value according to each of the sensing subpixel lines in an amount equal to the number of the sensing subpixel lines in the first panel region, and a second panel region defect detection processing of detecting a defect in the second panel region based on a sensing value according to each of the sensing subpixel lines in an amount equal to the number of the sensing subpixel lines in the second panel region.

10. The organic light-emitting display device according to claim 9, wherein a ratio of the sensing subpixel lines to all subpixel lines is within a range between a predetermined specific ratio and 100% in the first panel region, and a ratio of the sensing subpixel lines to the all subpixel lines is less than the predetermined specific ratio in the second panel region.

11. The organic light-emitting display device according to claim 9, wherein the sensing unit performs one of the first panel region sensing processing and the second panel region sensing processing, and secondarily performs the other.

12. The organic light-emitting display device according to claim 1, further comprising a compensation unit which performs a characteristics compensation processing by detecting characteristic values of the driving transistor within each of the subpixels based on the sensing value.

13. The organic light-emitting display device according to claim 1, wherein the sensing unit performs the sensing processing for each blank time section.

14. The organic light-emitting display device according to claim 1, further comprising a data driver which drives a data line in the display panel, wherein the data driver provides a recovery image data voltage to a second node of the driving transistor during a frame section after the sensing processing, and the recovery image data voltage is a voltage in which a recovery voltage is added to an image data voltage provided to the second node of the driving transistor during a frame section before the sensing processing.

15. A panel defect detection method of an organic light-emitting display device including a display panel in which subpixels are disposed in a matrix, each subpixel including an organic light-emitting diode and a driving transistor for driving the light-emitting diode, and a data driver connected to an upper portion or a lower portion of the display panel, the panel defect detection method comprising:

performing a sensing processing of sensing characteristic values of subpixels on sensing subpixel lines in an amount equal to a predetermined number of sensing subpixel lines in at least one of predetermined regions in the display panel, and outputting sensing values; and detecting a panel defect on the display panel based on the sensing values according to the sensing subpixel lines in an amount equal to the number of the predetermined sensing subpixel lines, wherein at least two subpixels on one of the sensing subpixel lines are electrically connected to different sensing lines.

16. The panel defect detection method according to claim 15, wherein the sensing subpixel lines in an amount equal to the number of the predetermined sensing subpixel lines are subpixel lines in an upper panel region or a lower panel region.

17. The panel defect detection method according to claim 16, wherein the sensing processing comprises performing a sensing processing on each of the sensing subpixel lines in an amount equal to the predetermined number of the sensing subpixel lines in the at least one of predetermined regions according to a sequential order or a random order.

* * * * *